United States Patent [19]

Toti

[11] 4,362,039

[45] Dec. 7, 1982

[54] APPARATUS AND METHOD FOR PRODUCING FOLDABLE METAL DRAPE PANELS

[76] Inventor: Andrew J. Toti, 311 W. River Rd., Modesto, Calif. 95351

[21] Appl. No.: 135,785

[22] Filed: Mar. 31, 1980

[51] Int. Cl.[3] ..... B21D 13/00; B21D 31/00

[52] U.S. Cl. ..... 72/186; 72/187; 72/372

[58] Field of Search ..... 72/177, 181, 182, 186, 72/187, 372

[56] References Cited

U.S. PATENT DOCUMENTS

| | | | |
|---|---|---|---|
| 1,295,769 | 2/1919 | Kux | 72/182 |
| 3,344,641 | 10/1967 | Pomory | 72/177 |
| 3,407,640 | 10/1968 | Lipp | 72/181 |
| 3,452,568 | 7/1969 | Vihl | 72/177 X |
| 3,931,725 | 1/1976 | Yon | 72/181 |
| 4,020,666 | 5/1977 | Beymer | 72/177 |
| 4,047,417 | 9/1977 | Oser et al. | 72/187 X |
| 4,145,905 | 9/1979 | Mattie | 72/177 |

*Primary Examiner*—James G. Smith
*Attorney, Agent, or Firm*—Flehr, Hohbach, Test, Albritton & Herbert

[57] ABSTRACT

A machine for producing metal drape panels having integral male and female hinge means formed therein at preselected intervals and a preselected cross-sectional profile. A first machine and method stage employs a plurality of rotary die stations to cut initial hinge patterns for the male and female hinge means and to equalize out of the strip any remanant curl or side curve while stretching the strip to increase the interval between initial hinge patterns to a final preselected interval. A second machine stage employs a plurality of punch die stations for forming the initial hinge pattern on the strip into final male and female hinge means and a shaping-compensating die station for simultaneously shaping the preselected cross-sectional profile and compensating out of the strip any inherent remaining curl or twist therein.

29 Claims, 43 Drawing Figures

APPARATUS AND METHOD FOR PRODUCING FOLDABLE METAL DRAPE PANELS

This invention relates generally to apparatus and methods for forming metal drape panels. More particularly, this invention relates to apparatus and methods for forming metal drape panels having integral male and female hinge means which may be slid together to form a multiple panel drape which can unfold and fold in an accordion fashion.

While this invention relates to apparatus and methods for producing metal drape panels, it will be helpful background information to consider the structure of the panel assembly and the individual panels which are produced. FIGS. 1 through 4 to the attached drawings show the overall assembled panel structure and the cross-sectional profile of each panel together with the integral hinge means performed on each panel. As depicted in FIG. 1, the panel structure to be produced by this invention comprises a panel assembly, generally designated with the reference numeral 1, which includes a series of foldably interconnected elongated slats or panels 2, each of which is hingedly connected with an adjacent panel by hinge means generally designated 3. The hinge means 3 are formed directly from the material of the panels to be interconnected so that separate hinge constructions are unnecessary. The panel assembly may be made up of only one section of individual panels of sufficient size to completely traverse a window opening or like area to be closed off thereby. Alternatively, two or more separate cooperable panel sections may be employed to close off such an opening.

The panel structure 1 is provided at its upper end with slidable means cooperable with supporting means to maintain the structure in its operative position. Such means, as seen in FIG. 1, comprise slide members 4 (or roller members, if preferred) pivotally connected with associated panels by means of links 6 which may be riveted, pinned or otherwise suitably secured to the top edges of associated panels. The slide members 4 are engaged with a traverse track of the supporting means in a known fashion so that the panel structure may be moved in accordion fashion from a retracted position to an expanded position, and vice versa, with the individual panels having the cross-sectional profile in the expanded version shown in FIG. 2 and the profile of the retracted position as shown in FIG. 3. Use herein of the term "accordion folding" means that alternate panels of the structure are foldable in opposite directions relative to a median vertical plane so that the structure when viewed from either side has a general appearance of the bellows of an accordion, particularly when the structure is retracted or partially retracted.

As shown in FIGS. 2 and 3, the preferred embodiment of such panels involves a transversely corrugated profile which adds decorative qualities as well as structural strength to the individual panels. As shown in FIG. 2, the preferred cross-sectional profile of the individual panels is a generally M-shaped corrugation, with the edge of the panel adjacent the female hinge means folded down from the leg of the M.

For more specific details of the panel structure and the integral hinges formed thereon, together with the method of assembly of individual panel sections into a overall foldable panel structure, reference is made to Toti U.S. Pat. No. 3,371,701, the specification of which is hereby incorporated by reference as if fully set forth herein.

FIG. 4 of the enclosed drawings depicts in partial plan view two adjacent panels as yet unassembled, together with a pattern of scribe lines 7, a weave pattern designated with a reference numeral 8, and a corrugated folded edge pattern generally designated with reference numeral 9. The scribe lines 7 serve the principal function of assisting in the formation of the M-shaped corrugated profile of each panel and also serve as a decorative vertical effect on each panel. The weave pattern 8 principally serves a decorative function to provide a cloth-like appearance for the metallic panel. The edge corrugation pattern 9 serves the dual function of a decorative effect together with a substantial strengthening of the edge of the panel adjacent the female hinge means 23.

For production of these foldable panel structures to be commercially feasible, it is an absolute requirement that an apparatus and method be provided for high speed automated production of individual drape panels with the integral hinge means formed therein. Not only must the process be highly automated, but the machinery for producing the panels must be capable of producing panels at a high yield, utilizing relatively low cost, semi-skilled personnel to run it. To produce panels at high yield requires apparatus that is capable of carrying out a number of die cutting and forming steps in a highly regular and precise fashion. The metal employed in the individual panels is a relatively hard aluminum alloy which is generally processed in coils or rolls of strip material, each coil or roll having its own individual characteristics depending on the processing thereof by the manufacturer. Consequently, in order to produce individual panels at high yield, it is necessary for the automated apparatus to be able to compensate for individual characteristics of each roll of strip material. Because of the inherent characteristics involving inherent "memories" in the strip of metal and memories which may be induced during the several die cutting and forming processes involved in the apparatus, high yield in the automated production process can only be achieved if sufficient equalizing and compensating for these memories can be achieved on a readily adjustable high speed production basis.

One of the problems that can be encountered in automated production due to such metal memories are inherent side curves in the rolls of metal stripping which will cause the individual panels to have a side bow. In addition, the individual metal panels may have a tendency to twist in one axial direction or the other or may have a tendency to curl upward or downward. In order to produce a commercially satisfactory foldable panel structure, side curves, curls, and twists must be substantially eliminated from each individual panel or slat or else the overall integrated panel structure will curl, fan out, or otherwise distort in a manner which is displeasing from an aesthetic standpoint and would prevent customer satisfaction.

Prior to the making of the inventive apparatus and method described herein, a prior semiautomated machine was utilized to make individual panel structures, but with only limited success. The prior machine was capable of producing acceptable individual panels only at relatively low yield (less than ninety percent) and then only when the equipment was operated by a highly skilled operator thoroughly familiar with the critical adjustments on the machine. The prior apparatus is depicted schematically in FIG. 5. The essential character of this prior machine is that the continuous strip of metal is driven through the various die stages in a stepping fashion. In other words, the continuous strip was stepped the incremental interval between successive pairs of male and female hinge means (typically six inches) so that the various cutting and shaping dies could operate on the strip each time the strip stepped an incremental hinge interval.

Referring now to the system shown in FIG. 5, the die stages or stations included in the prior machine were a rotary embossing die station 10, a rotary weave and strip driving die station 20, a multistage cutting and shaping punch die station 30, an M shaping die station 40, a rotary corrugation-tension die station 50, and a strip shearing die station 60. The rotary embossing die station 10 functioned to produce a regular pattern of embossments of the continuous strip 80. The rotary weave and strip driving die station 20 produced a weave pattern on strip 80. The multistage cutting and shaping punch die station 30 involved a number of die stages where first an initial hinge pattern is cut in the strip 80 and partially shaped, followed by additional punch die stages for finishing the shaping of the male and female hinge means. The M profile shaping die station 40 transforms the flat strip into a strip with an M-shaped corrugated profile. The rotary corrugation-tension die 50 contacted strip 80 at a central section thereof and produced a corrugation pattern in this central region. The shearing die 60 simply operated to cut the continuous strip to a preselected length.

The operation of the rotary weave and strip driving die station 50, the multistage cutting and shaping punch die station 30 and the rotary corrugation-tension die station 50 was powered by a timing-driving arrangement 70. The rotary weave and strip driving die 20 was driven by a reciprocating drive arrangement controlled by an air operated clutch 72 operating from the motor-flywheel combination 71. In other words, the reciprocating drive with air operated clutch 72 is powered by the motor-flywheel 71 to rotate the rotary weave and strip driving die 20 a prearranged amount to step the continuous strip 80 incremental intervals equal to the hinge interval through the various die stages. To maintain tension on the strip as it passes through the various die stages, the rotary corrugation-tension die is driven with an air operated clutch from the motor-flywheel 71 to maintain a constant pull on the strip. Timing cam drives 73 are utilized to time the punching action of the cutting and shaping dies at station 30 with respect to the six-inch incremental stepping movement of the strip produced by the rotary weave and strip driving die 20. In other words, the driving die 20 operates to move the continuous strip an incremental distance (e.g., six inches) whereupon the strip stops while the cutting and shaping dies in station 30 operate to form the integral hinge means. A second timing cam drive 75 is utilized to operate shearing die 60 with a separate control on this drive to control the number of steps that the strip takes prior to shearing. In addition, the shearing die can be moved with respect to the strip in order to control the length of the panel produced.

A number of problems were encountered in manufacturing acceptable panels with the prior art machine shown in FIG. 5. The air operated clutches associated with the reciprocating drive 72 and the tension drive 74 would operate from time to time with different degrees of slippage, such that it was difficult to reproducibly control the tension on the strip between the driving die 20 and the tension die 50. Varying amounts of tension in the strip would, of course, cause a differential amount of stretching of the strip between these two dies and thus cause differences in the incremental distance between the hinge means formed in the strip. In addition, the accuracy of the strip driving die 20 in stepping the continuous strip six inches through the various die stations was not sufficiently controllable even with a brake action on the strip driving die to produce a reproducible incremental stepping of the strip. This would also affect the spacing between pairs of male and female hinge means.

In addition to the difficulty of producing a hinge pattern at regular incremental intervals on a strip passing through the prior machine, the M-shaping die 40 and the rotary corrugation-tension dies 50 had only limited capability to be adjusted to equalize out of the metal strip any remanant or induced memories which would otherwise cause the strip to have a side curve or a twist or a curl. In particular, the M-shaping die had only limited capability of being adjusted to eliminate curling of the panels and had no ability to compensate for inherent twist in the strip passing therethrough. The rotary-corrugation tension die could be utilized to some extent to compensate for inherent twisting of the strip by a slight movement of the die to one side or the other on the strip, but had little or no ability to equalize the remanent memories in the strip by differential stretching action on one side or the other to eliminate side curves.

It should thus be apparent that the prior art machine depicted in FIG. 5 could only have limited success in producing acceptable panels for use in a foldable panel structure as depicted in FIG. 1. Consequently, to produce panel structures of acceptable quality at reasonable cost necessitated the development of an improved machine capable of being operated by only semiskilled operators to produce acceptable panels at much higher yields.

Accordingly, a principal object of this invention is to provide an improved apparatus and method for producing metal drape panels having integral male and female hinge means formed therein at regular incremental intervals and a preselected cross-sectional profile.

More specifically, it is an object of this invention to provide apparatus and method for producing metal drape panels with integral male and female hinge means at low manufacturing cost and high yield.

The achievement of the above-stated objects is attained by apparatus in accordance with this invention by providing, in combination, rotary die means for cutting, at precisely spaced intervals, initial hinge patterns for successive pairs of male and female hinge means on a continuous strip of thin metal passing therethrough; equalizing die means for controllably stretching the strip as it passes therethrough to adjust the overall incremental distance between pairs of initial hinge patterns thereon; and driving means for pulling the continuous strip through the rotary die means and the equalizing die means while maintaining substantial tension in the strip as it passes through the die means. In preferred apparatus according to this invention, the equalizing die means includes an adjustable die element having two degrees of adjustment for simultaneously controlling the overall incremental distance between successive pairs of hinge patterns formed in the strip and, when required to remove a detected side curve in the strip, to increase the length of one side of the strip with respect to the other.

Preferred apparatus according to this invention also includes the following additional rotary dies. The first of these additional rotary dies produces a continuous pattern of scribe lines on the strip of metal passing therethrough with the scribe line pattern being preselected in accordance with the ultimately desired cross-sectional profile of the metal drape panel. An additional rotary die is utilized to form a pattern of embossments on the strip between the lines in the scribe line pattern. Another rotary die is utilized for producing a preselected weave pattern between the scribe lines on the strip.

The preferred apparatus in accordance with this invention also includes a second machine stage comprising in combination: punch die means for forming the integral male and female hinge means as successive ones of the initial hinge patterns in the strip are positioned thereunder; shaping-compensating die means for simultaneously forming the preselected cross-sectional profile and compensating for any inherent twist or curl in the continuous strip passing therethrough; reciprocating drive means, including means engaging at least a pair of male and female hinge means, for driving the continuous strip a precise incremental distance equal to the incremental intervals between the hinge means during successive actuations thereof, both to position successive portions of the strip accurately under the punch die means and to drive the strip through the shaping-compensating die means; and timing-driving means for producing proper sequential operation of said punch die means and said reciprocating drive means.

A preferred version of this second machine stage also includes a second equalizing die means preceding the punch die means and selectably operable to stretch one side of the strip to remove any detected side curve not eliminated by said first equalizing die means; and a rotary edge bending die means preceding the punch die means for simultaneously bending and corrugating a predetermined narrow segment of the edge of the strip adjacent the initial female hinge pattern thereon.

The method for forming metal drape panels in accordance with this invention includes the steps of: (1) feeding successive portions of a continuous strip of metal from a supply roll through a plurality of rotary die stations while maintaining substantial tension on the strip; (2) forming at one of the rotary die stations initial hinge patterns for successive pairs of the male and female hinge means at initial intervals slightly less than the preselected intervals of the final male and female hinge means on the panel; and (3) stretching the strip at a subsequent one of the rotary die stations by a controlled amount to increase the initial intervals between the successive pairs of initial hinge patterns to be equal to the preselected intervals of the final hinge means.

In the preferred version of the method of this invention, the third step of stretching the strip includes stretching one side of the strip a greater amount than the other when necessary to compensate for a detected side curve in the strip.

In addition, the preferred method in accordance with this invention further comprises the following additional steps: forming at one of the rotary die stations a pattern of scribe lines for assisting in forming the preselected cross-sectional profile of the metal drape panel; forming at another of the rotary die stations a pattern of embossments between the scribe lines; and forming at another of the rotary die stations a preselected weave pattern between the scribe lines.

The preferred method in accordance with this invention also includes the additional steps of stepping the continuous strip having the initial hinge patterns therein through a plurality of punch die hinge forming stations and a profile shaping die station at precise incremental distances equal to the preselected intervals between the hinge means; forming at said punch die stations the integral male and female hinge means as successive ones of the initial hinge patterns in the continuous strip are positioned thereat; and forming the strip at said profile shaping die station into a preselected cross-sectional profile and simultaneously compensating out of the strip any inherent twist or curl detected therein.

The essential advantage of the apparatus and method in accordance with this invention is tnat they provide an approach to forming metal drape panels with rigorous control of all of the parameters which must be controlled for high yield manufacture of individual drape panels which can then be assembled into a high quality foldable panel structure. The use of rotary dies to cut the initial hinge patterns together with the use of equalizing die means for controllably stretching the strip and a driving means which pulls the strip through the rotary die means and the equalizing die means enables extremely precise control over the incremental distance between the initial hinge patterns formed in the continuous strip while equalizing out remanant and induced memory states in the strip which would otherwise produce side curves and curls therein. In addition, the employment of a rotary die to produce a pattern of scribe lines in the strip greatly assists in reproducibly forming the preselected cross-sectional profile of the strip. In the second machine stage, the use of a reciprocating drive means which includes means that actually engage the male and female hinge elements to drive the continuous strip enables the advantageous reciprocating drive of the strip an incremental distance precisely equal to the preselected intervals between the hinge means in the final drape panel. The accuracy of the reciprocating drive means in this second machine stage enables successive portions of the strip to be accurately located under the punch die forming means so that the male and female hinge means are accurately produced. The ability of the shaping-compensating die means to simultaneously form the preselected cross-sectional profile and compensate for any inherent twist or curl in the strip passing therethrough makes it possible to manufacture metal drape panels which are completely straight and will, when assembled into a panel structure, produce an overall drape which does not fan out or curve or have other deficiencies in quality. It should thus be apparent that the apparatus and method of this invention provides numerous advantages over the prior art machine previously described.

Other objects, features, and advantages of this invention will be apparent from the following detailed description in conjunction with the accompanying drawings.

Figure 6:
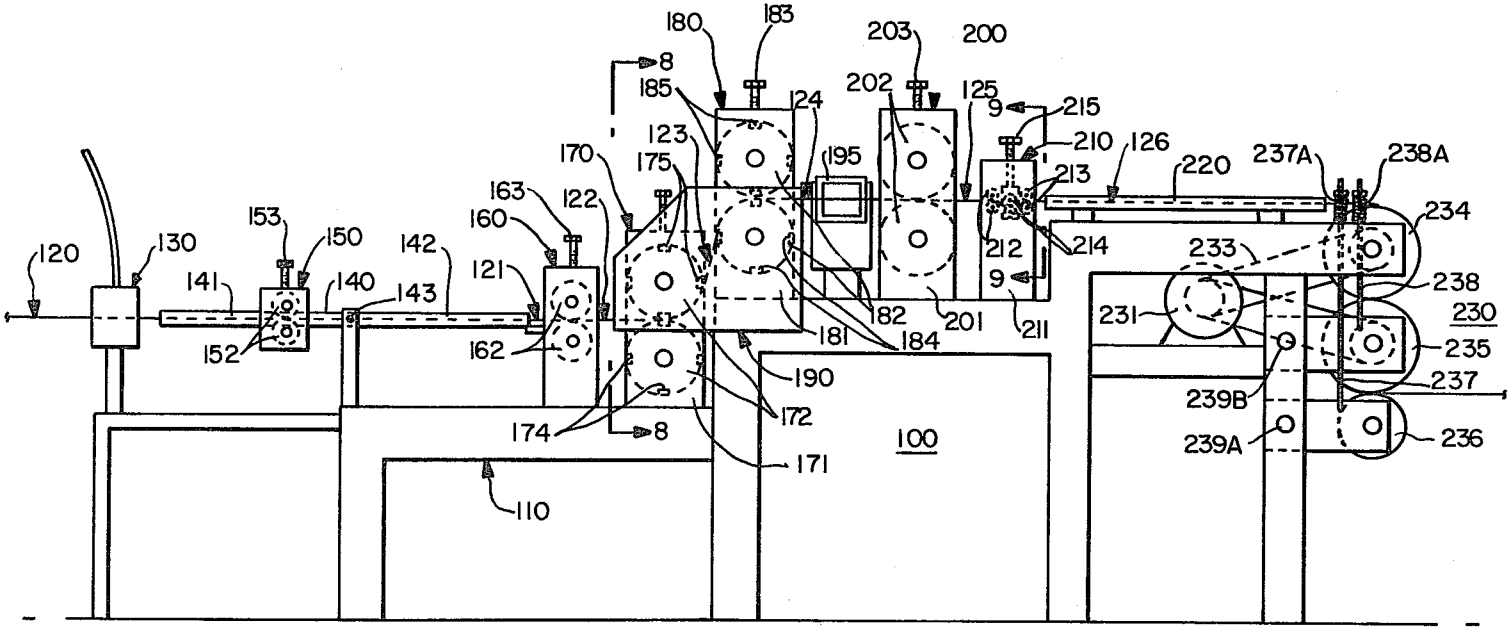
FIG. 6 is a schematic elevational view of a first machine stage for forming metal drape panels in accordance with this invention.
Figure 7A:
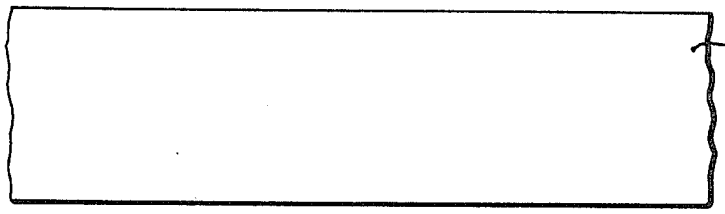
FIG. 7A–7F are partial plan views of segments of a metal strip depicting the various stages of operations performed by the apparatus shown in FIG. 6.
Figure 7B:
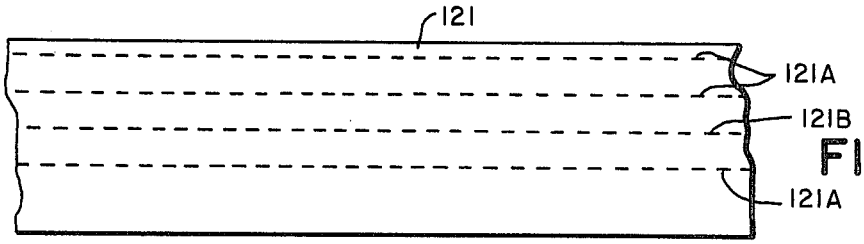
Figure 7C:
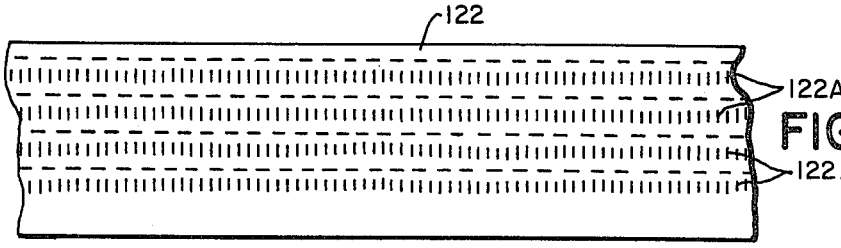
Figure 7D:
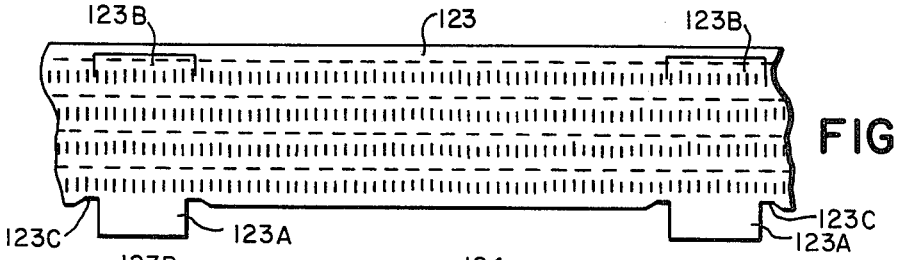
Figure 7E:
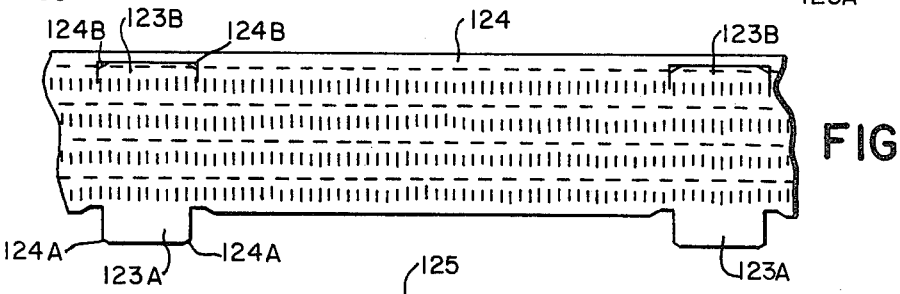
Figure 7F:
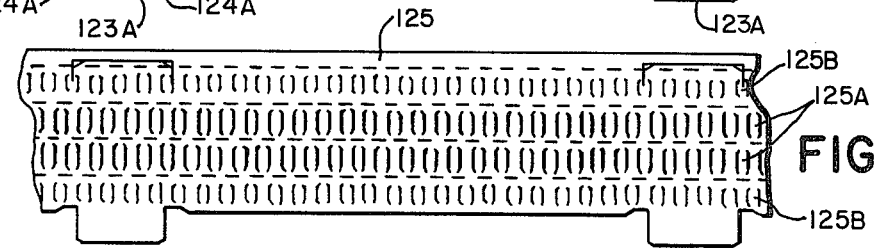
Figure 8:
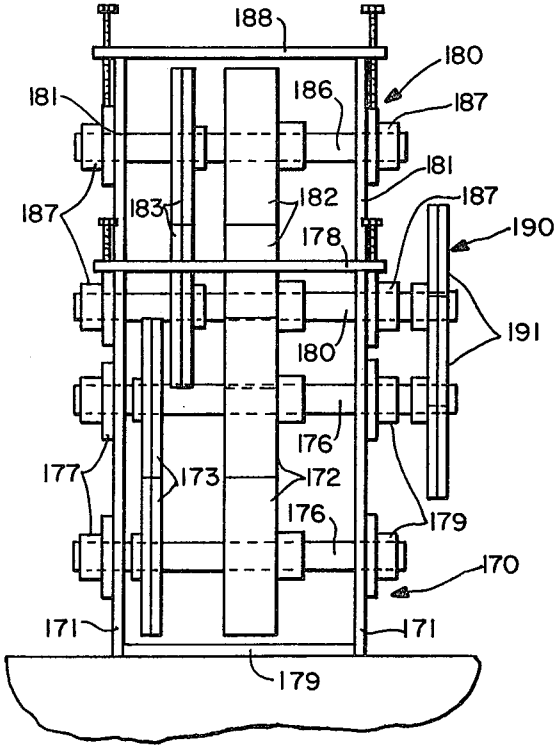
FIG. 8 is a front elevational view of one of the rotary die stages taken along the line 8—8 in FIG. 6.

Referring now to FIGS. 6, 7 and 8, the structure and function of the first machine stage 100 of the apparatus of this invention will be described. Generally, the first machine stage 100 includes a driving means 230 and a plurality of rotary die stations 150, 160, 170, 180, 200, and 210, all mounted on a frame arrangement 110. The driving means 230 pulls a continuous strip of thin metal 120 from a supply reel (not shown) and through the plurality of rotary die stations while maintaining tension on the strip. The amount of tension is based on the cumulative loading produced by the various rotary die stages and is generally about sixty percent of the strip breaking force at the maximum tension point. This tension in the strip assists in equalizing out the memories. The material of the continuous metal strip is a relatively hard aluminum alloy which has preferably already been coated with either a solid color paint or a printed paint pattern. The metal strip is preferably about 0.010 inches thick and about two inches wide. There is, however, nothing critical about the width or thickness, and the invention could readily be adapted to strips of different widths and thicknesses. The strip material is essentially standard Venetian blind stock which has been adapted for the purposes of forming the metal drape panels in accordance with this invention.

FIG. 6 shows schematically the various rotary die stations through which the continuous strip of thin metal passes between the supply reel (not shown) and the driving means 230. FIGS. 7A through 7F depict the appearance of the strip after having passed through the individual rotary die stations. As shown in FIG. 6, the first stage which the strip 120 encounters is a lubricating device 130 which puts an oily lubricating liquid on the top and bottom surfaces of the strip to assist in feeding the strip through the various rotary die stages. After passing through the lubricator, the strip encounters a guide arrangement 140 leading into and out of rotary die station 150. The strip guide section 141 ensures that the horizontal position of the strip will be accurate as it is fed into the first rotary die stage 150. Rotary die stage 150 produces a preselected pattern of scribe lines on strip section 121 as depicted on FIG. 7B. The scribe lines 121A are a dashed pattern of downward embossments on the strip, whereas the scribe line 121B is an upward pattern of embossments on the strip. As will later be seen, this pattern of scribe lines is utilized to assist in forming the final M-shaped corrugated cross section of the panels as shown in FIG. 2.

The metal strip then passes through guide section 142 to guide the strip into a second rotary die station 160 which produces a pattern of embossments on the strip as depicted in FIG. 7C. As FIG. 7C shows, embossments 122A are formed between the scribe lines 121A. The embossments 122A are made lightly, in order to avoid marring the paint on the strip. The purpose of these embossments is to begin to stretch and work the metal in between the scribe lines 121A to make it easier to form the weave pattern subsequently produced.

Figure 2:
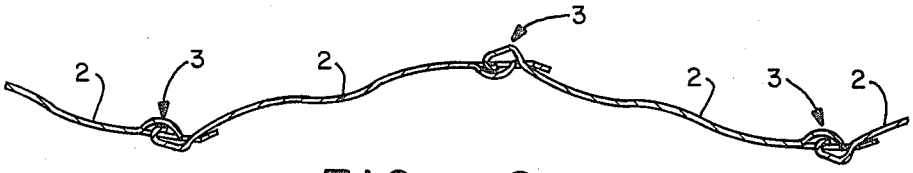
FIG. 2 is a horizontal section view through the expanded panel structure of FIG. 1 taken in the plane of the line 2—2 thereof.
Figure 3:
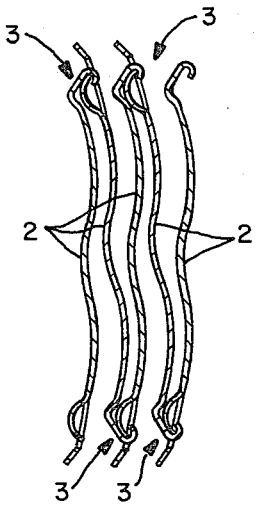
FIG. 3 is a horizontal section view through the panel structure showing the panels thereof compactly folded in the retracted position.
Figure 4:
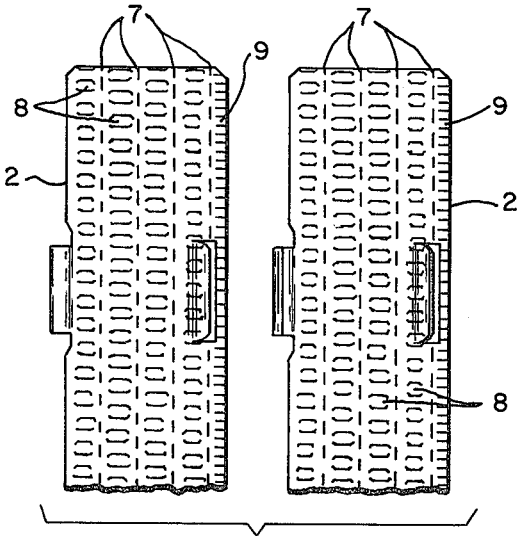
FIG. 4 is a partial plan view of two individual panels as they appear prior to assembly of the male and female hinge means.
Figure 5:
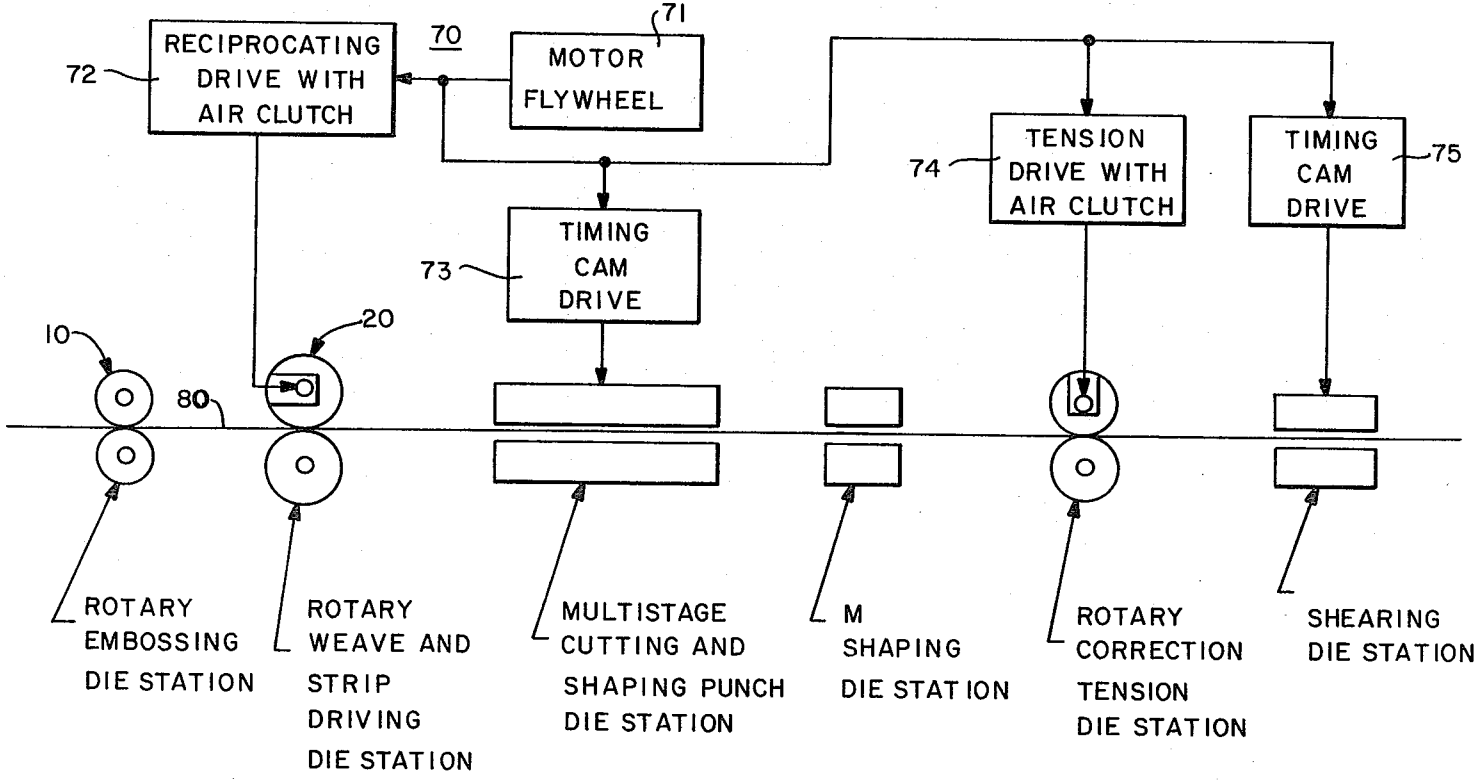
FIG.—5 PRIOR ART
FIG. 5 is a schematic diagram of a prior art machine for forming metal drape panels with integral hinge means.

After passing through the embossing die station 160, the strip enters a first rotary cutting die station 170 which cuts a portion of the initial hinge pattern for the male and female hinge means depicted in FIGS. 2, 3, and 4. The intial hinge pattern is as shown in FIG. D. As seen in FIG. 7D, portions of the bottom edge of the strip have been cut away to form a pattern of tongues 123A which will later be shaped to form the male hinge means of the panel. Thus, the initial hinge pattern for the male hinge is simply a tongue 123A with a slight undercutting 123C into the edge of the strip at both ends of the tongue. In the top of the strip, an initial inverted U-shaped cut has been made in the metal in a region moderately spaced from the top edge of the strip. This forms a tab 123B as the initial female hinge pattern which will later be formed into the female hinge means depicted in FIGS. 2, 3, and 4. After passing through the first rotary cutting die station 170, the strip passes into a second rotary cutting die station 180 which simply cuts the corners 124A off of the male hinge tongues 123A and the corners 124B off of the female hinge tabs 123B, as depicted in FIG. 7E. A motor driven blower 195 is utilized to blow these corners away from the metal strip 124 before it passes into the rotary weave die station 200.

The rotary weave die station 200 produces a weave pattern in between the scribe lines as shown in FIG. 7F. The two rows of weave patterns 125A comprise relatively deep cuts which actually slice through the metal at the edges of the pattern and provide a raised area which imitates the in and out woven threads of a cloth. The two outer rows 125B of weave patterns are shallower and do not actually cut all the way through the metal. However, the overall visual effect is that of a woven cloth pattern extending transversely across the drape panel.

After passing through the weave die station 200, the strip passes into an equalizing die station 210 which does not change the appearance of the strip but performs several useful operations in working the metal of the strip to enable latter achievement of a straight panel with precise spacing between the integral male and female hinge means. The operation of the equalizing die station 210 will be described later in greater detail since this is a critical aspect of the apparatus of this invention.

After passing through the equalizing die station 210, the strip is guided through a guide channel 220 onto the first wheel 234 of the driving means 230. The strip wraps around the first drive wheel 234 and then wraps around the second drive wheel 235 and exits between the wheel 235 and the third idler wheel 236. From thence, the strip is either rolled up on a take-up reel (not shown) or is directly fed to the second machine stage to be described later.

Having generally described the operations performed at the various rotary die stations in the first machine stage 100 depicted in FIG. 6, some constructional details of the various rotary die stages will now be briefly discussed. In general, most of the rotary die stages involve state of the art type rotary die techniques and could be readily fabricated by skilled die makers based on the patterns depicted in FIGS. 7A through 7F.

The guide means 140 on the front end of the machine includes an initial guide section 141 and a second guide section 142. The two guide sections are pivotally mounted at point 143 on a vertical support element. The rotary die station 150 is permanently attached to the two guide elements. Each of the guide elements 141 and 142 keeps the strip from flopping up and down vertically and guides the edges of the strip of metal into the scribe line rotary dies 152 at scribing die station 150 and the rotary embossing dies 162 at embossing die station 160. The side guiding of the strip at this point is important since the amount of tension on the strip due to the loading from the scribing dies 152 and the embossing dies 162 may not be sufficient to maintain the strip in proper alignment with the dies.

The scribing die station 150 essentially comprises a die support structure 151 for the two rotary scribing dies 152. A pair of thumbscrews 153 is utilized to control the pressure between the rotary scribing dies 152 and thus the depth of the scribing on the strip. The rotary scribing dies 152 are mounted on shafts and a suitable bearing arrangement (not shown) which enables rotation of the dies 152 on their shafts or with respect to the mounting cage may be employed. The structure of the rotary scribing dies 152 should be apparent from the pattern of scribe lines 121A and 121B shown in FIG. 7B. While a pattern of dashed lines of varying length is utilized in exemplary apparatus, it should be apparent that a variety of scribing line designs could be utilized for purposes of assisting in the later performed bending of the metal strip at the scribe lines to form a corrugation pattern in the strip.

The embossing die station 160 generally comprises a die support structure 161 for mounting a pair of embossing dies 162 is a rotating fashion. The rotary embossing dies 162 essentially comprise four parallel sets of sharp toothed gears which are partly meshed to provide a light embossing of the strip of metal passing therebetween. The degree of meshing of the rotary embossing dies 162 can be controlled by a pair of thumbscrews 163 which determine the position of the upper die with respect to the lower. The particular shape of the gear teeth on the rotary embossing dies is not critical since the essential purpose of this light embossing operation is to begin to stretch the metal between the scribe lines to make it easier to form the subsequent weave pattern in the strip at the later rotary weave die station.

The two rotary cutting die stations 170 and 180 will be described with respect to FIG. 6 and the plan view thereof taken along the line 8—8 in FIG. 6. Referring to the first rotary die station 170, a pair of vertical side walls 171 are mounted on the frame 110 with a top wall 178 and a bottom wall 179 completing a cage construction for supporting the two rotary cutting dies 172. This die support cage is preferably mounted on frame 110 in a horizontally slidable fashion with the exact side-to-side and front-to-back position of the cage determined by pairs of side and front adjustment screws (not shown). In this fashion, the position of the rotary cutting dies 172 can be very accurately located with respect to the metal strip exiting the embossing die stage 160. Each of the rotary cutting dies 172 is rigidly fixed to its respective shaft 176 with the ends of the shaft extending through the vertical supports 171 into bearing members 177 which are physically mounted externally on the vertical side supports 171. These shafts 176 also carry gear sets 173 which mesh tightly together to maintain the relative rotational positions of the two rotary dies 172. Each of the gear sets 173 is a parallel pair of gears, with one of the gears fixed on the shaft and the other spring loaded with respect to the other gear to eliminate the play which is otherwise inherent in a gearing arrangement. In other words, the spring loading of the gears places one set of engaged gears in a meshing position with the front gear teeth walls spring loaded into contact with each other, and the other set of engaged gears are torqued by the spring to have the back gear teeth walls in contact with each other. This completely eliminates any play in the gears and precludes the two rotary cutting dies from shifting circumferentially with respect to each other.

As shown in FIG. 6, each of the lower and upper rotary cutting dies 172 has four equally spaced cutting die positions 174 and 175 thereon, respectively. The circumference of each of these rotary cutting dies is carefully machined to produce very accurate cutting of the initial hinge patterns in the strip as shown in FIG. 7D at precise intervals. The precise details of the cutting dies which are mounted in the rotary die wheels 172 are not shown, but skilled tool and die artisans would readily be able to fashion the appropriate dies from the shapes of the initial hinge patterns depicted in FIG. 7D. Preferably, each of the actual cutting dies mounted in the rotary die wheels is individually adjustable with respect to its vertical and circumferential position on the die wheel so that precise cutting and precise spacing between cuts can be achieved.

The structure of the rotary die station 180 is essentially identical to that of the rotary die station 170. The respective elements are numbered with the same numbering sequence starting with 180 and repetition of this structure is unnecessary. In addition to the individual sets of parallel gear wheels on the two shafts 176 at station 170 and the two shafts 186 at station 180, a die-aligning gearing arrangement is provided between lower shaft 186 at station 180 and the upper shaft 176 at station 170 to maintain precise alignment between the two rotary cutting die stations. Consequently, a pair of parallel gears 191 is provided on each of the lower shaft 186 and upper shaft 176 with these parallel gears also spring loaded with respect to each other to eliminate play. In this fashion, the two rotary cutting die stations have the rotary cutting dies therein completely geared together to function in a synchronized fashion.

Rotary weave die station 200 includes a pair of vertical side supports 201 which support a pair of rotary weave dies 202 on respective shafts which may be journaled in bearings in any suitable manner to provide rotation between the two rotary weave dies 202. A pair of thumbscrews 203 may be utilized to control the position of the upper rotary weave die 202 with respect to the lower to control the depth of the weave formed in the metal strip passing therebetween. The form of the rotary weave dies 202 is readily apparent to the skilled die maker from the weave pattern depicted in FIG. 7F. Essentially, the rotary weave dies 202 each comprise four sections of die wheels, with the two central die wheels being more closely meshed with larger circumferences than the two outer die wheels. In addition, the teeth on the rotary weave dies are offset in order to produce the desired weave pattern. It is, of course, important to carefully make these rotary weave dies in order to avoid marring the paint which has previously been coated on the strip. The actual size of the weave pattern is not critical and any reasonable pattern may be employed.

Equalizing die station 210 generally comprises a pair of vertical side walls 211, two end pairs of rotary dies 212 and 213 mounted in a fixed location, and a central pair of rotary dies 214, the respective vertical positions of each end of the central pair of dies 214 being separately adjustable by individual thumbscrews 215. The precise structure of the equalizing die station 210 will be more apparent from a detailed description of one exemplary preferred embodiment of this die station depicted in FIGS. 9–11. Before describing in detail the structure and function of equalizing die stage 210, the remainder of the apparatus shown in FIG. 6 will be described.

The drive means 230 actually provides the driving force for all of the rotary dies at the various rotary die stations in machine stage 100. In other words, the rotary dies at the various stations are actually turned by the strip of metal as it passes therethrough while being pulled by the drive means 230. Referring back to the two rotary cutting die stations 170 and 180, one purpose of offsetting the two rotary die stations at this point is to provide additional traction of the strip on the circumference of the upper one of the rotary dies 172 and the lower one of the rotary dies 182 to maintain constant precise rotation of the rotary cutting dies with respect to the strip. In other words, the longer contact surface between the dies 172 and 182 and the strip ensures that the strip will not slip between the dies but the rotary dies will turn circumferentially the same distance that the strip traverses in passing through the dies so that the precision of the locations of the initial hinge patterns on the strip will be maintained.

The drive means 230 includes an electric motor 231 which is shown directly powering the drive wheels 234 and 235 through a pair of drive chains 232 and 233. If necessary, the motor 231 may be geared with respect to the drive chains in order to provide sufficient torque to pull the strip through the rotary dies by overcoming the cumulative loading on the strip in passing through the respective die stations. Each of the drive wheels 234, 235, and 236 consists of a central hub and a rubber tire mounted on the hub so that the strip is in contact with a resilient surface in passing over the drive wheels so as not to mar the surface of the strip or affect the weave pattern formed therein. The support arms which mount the drive wheel 235 and the idler wheel 236 are pivotally mounted on the frame 110 at the points 239A and 239B. A spring loaded arm 237 including compression spring 237A is employed to urge the idler wheel 236 against the drive wheel 235. A second spring loaded arm 238 including compression spring 238A is utilized to urge drive wheel 235 into a gripping contact with drive wheel 234. In this manner the strip passing over the drive wheels 234 and 235 is positively gripped with resilient means to prevent slipage of the strip as it is pulled through the respective sequential rotary die stations. It should, of course, be apparent to those skilled in the art that other forms of drive means could be utilized, provided the requirements of a resilient holding of the strip to avoid marring the painted surface or affecting the weave pattern is provided.

Figure 11:
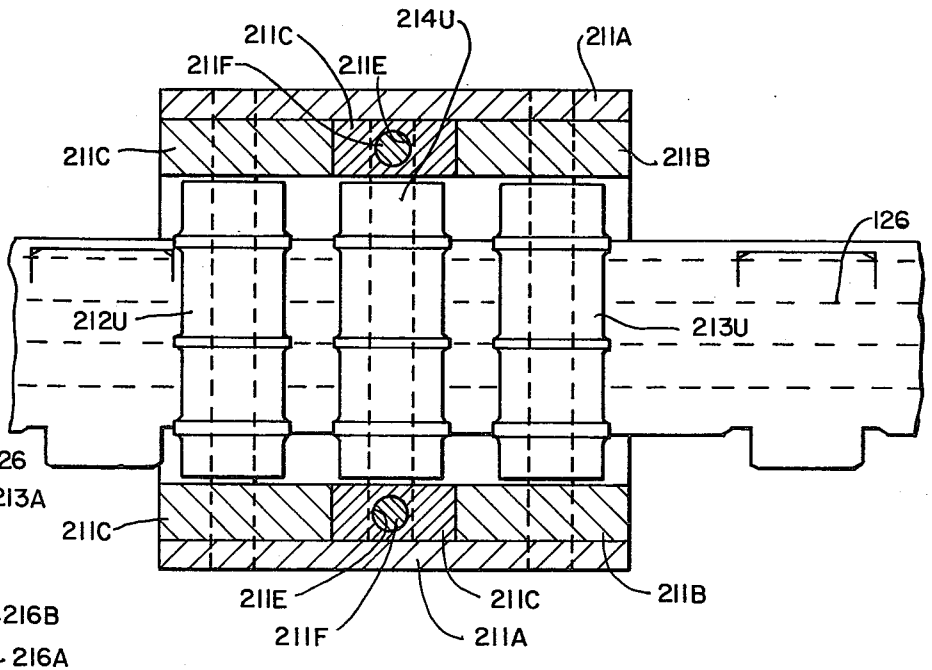
FIG. 11 is a partly sectioned top view taken along the line 11—11 in FIG. 10.
Figure 10:
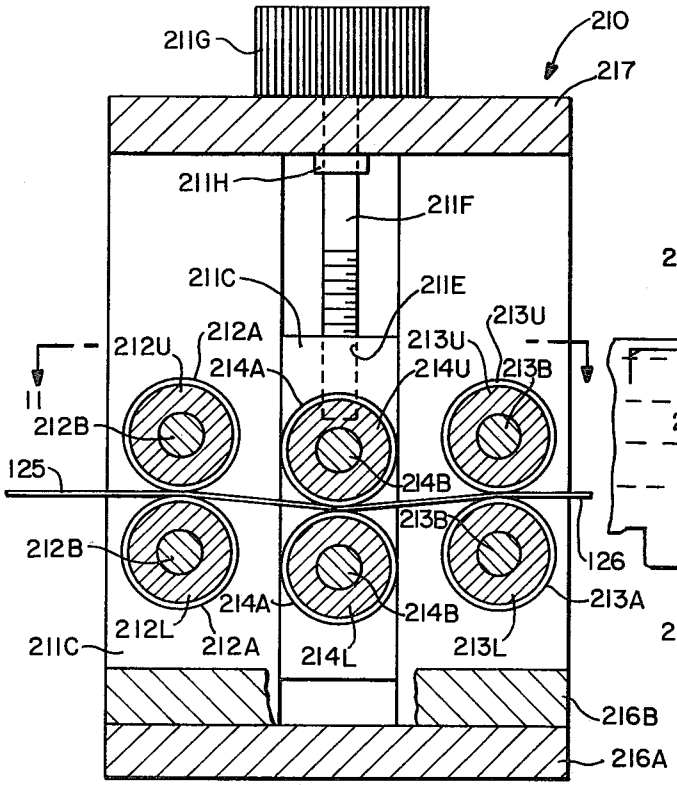
FIG. 10 is a partly sectioned plan view taken along the line 10—10 in FIG. 9.

FIGS. 10–12 depict the structure of the equalizing die station 210. The vertical side walls 211A form together with the bottom walls 216A and 216B and the top wall 217, a rigid box-like cage for the three sets of rotary dies 212, 213, and 214 mounted internally of the cage structure. Any suitable fastening means can be employed to fasten these respective side, top and bottom walls together to form the rigid cage. A pair of inner side walls 211B are mounted to the outer side walls 211A on each side of the rigid cage to form a groove 211D in which a pair of separate moving walls 211C ride. The rotary dies 212 and 213 are journaled with bearings on the shafts 212B and 213B which are fixedly mounted in apertures in the walls 211A and 211B. The dies 214 are mounted on shafts 214B with an appropriate bearing arrangement, and the shafts 214B are permanently mounted in the moving side walls 211C. Each of the two moving side walls 211C has a tapped hole 211E formed in the top thereof which receives a threaded shaft 211F attached to a knurled thumbscrew 211C. A collar bushing 211H is rigidly fixed on the threaded shaft 211F to prevent the threaded shaft from pushing vertically up through the apertures 17A in the top wall 217.

As shown particularly in FIG. 10, the raised circumferential rings 213A contact the metal strip passing through the dies 213 at the right and left edge of the strip and the middle of the strip along the central scribe line. Similar rings 212A on rotary dies 212 and rings 214A on rotary dies 214 contact the strip at similar places. These raised circumferential rings 212A, 213A, and 214A enable the respective pairs of dies to contact the strip at appropriate points without contacting the raised portions on the strip which comprise the weave pattern produced by the rotary weave dies at station 200. It should be apparent that if the weave cut pattern were not provided in the strip, then the rotary dies 213, 214, and 215 could contact the strip throughout its entire width.

Considering FIGS. 10, 11 and 12 together, it is noted that, by turning the knurled screw heads 211G, each of the two moving side walls 211C associated with the central pair of rotary dies 214 can be moved up and down in the respective side grooves 211D. By simultaneously turning the two screwheads 211G, both ends of the central rotary dies 214 will raise or lower the same distance. By turning only one of the screws, the parallel axes of the central rotary dies 214 can be canted with respect to the axes of the front and rear parallel dies 212 and 213. It is these two separate degrees of adjustment of the central rotary dies 214 which permits the equalizing die station simultaneously to stretch the strip and to remove detected side curves from the strip passing through the equalizing die station 210.

Equalizing die station 210 performs two essential, critieal functions with respect to the formation of metal drape panels with integral male and female hinges spaced at preselected intervals. Referring to FIG. 11 in connection with FIG. 6, it will be recalled that the rotary cutting die stations 170 and 180 have rotary cutting dies 172 and 182 which are designed to cut the initial hinge patterns for the male and female hinge means in the metal strip at incremental distances less than the final preselected intervals desired for the finished hinge means. At equalizing die station 210, the distance between the initial hinge patterns on the strip can be adjusted by performing a controllable stretching of the strip to lengthen the incremental interval between initial hinge patterns formed in the rotary cutting dies at stations 170 and 180 to the final preselected intervals for the hinge means in a finished panel. The amount of stretching of the metal strip as it passes through the equalizing die station 211 is controlled by the vertical position of the central pair of rotary dies 214.

Figure 12A:
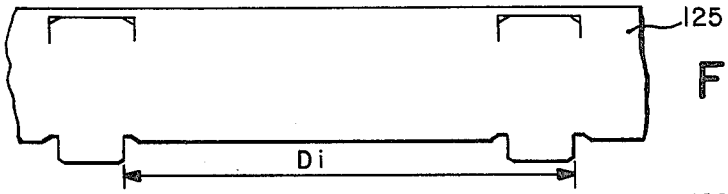
FIGS. 12A and 12B are partial plan views of segments of a metal strip illustrating the operation of the equalizing die means of FIGS. 9–11.
Figure 12B:
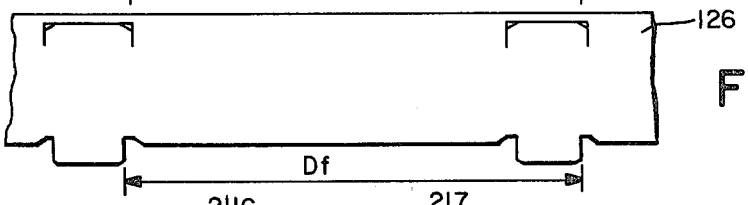

Remembering that the metal strip is held in substantial tension as it passes through the equalizing die station 210, it will be appreciated that, as the vertical position of the central pair of rotary dies 214 is lowered, the incremental section of the strip between the outside pairs of rotary dies 212 and 213 will be stretched to a greater degree because of the increased downward force on the strip. This effectively increases the tension in the strip to produce inelastic stretching of the strip. Thus, by adjusting the vertical position of the central pair of rotary dies 214, a controlled amount of lengthening of the initial interval between initial pairs of male and female hinge patterns previously formed in the metal strip can be performed. FIGS. 12A and 12B illustrate this stretching process of the equalizing die station 210. FIG. 12A depicts the strip section 125 entering die station 210 and FIG. 12B the strip section 126 exiting die station 210. The initial hinge pattern interval $D_i$ in strip section 125 is increased to a final interval $D_f$ in strip section 126.

Figure 13:
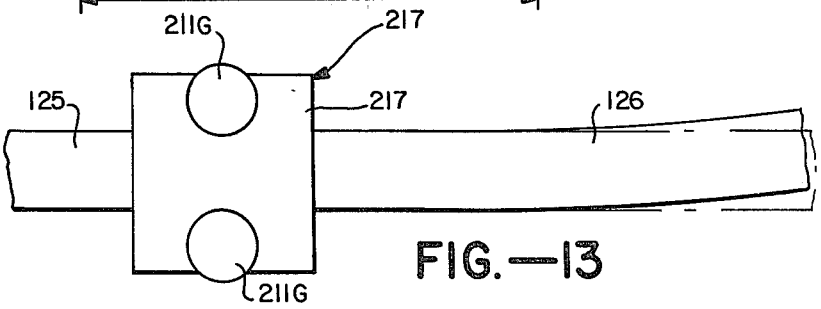
FIGS. 13–16 are schematic views depicting the operation of the equalizing die means shown in FIGS. 9–11.
Figure 14:
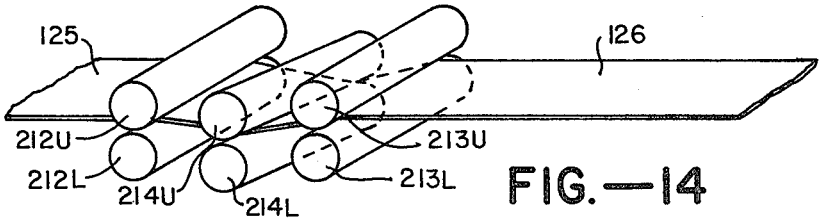

One of the problems frequently encountered in coils of metal stripping is a transverse curve either to one side of the other due to remanant memories produced in the coiled strip during its initial manufacture or due to induced memories in the metal strip caused in the various rotary die stations. FIGS. 13–16 illustrate how the equalizing die station 210 is utilized to eliminate side curves from the metal strip. FIG. 13 shows a top view of the metal strip passing through equalizing die station 210 and having a left side curve. If this left side curve were not removed from the metal strip, each panel formed from the metal strip would also have this side curve and could not be used. Utilizing the equalizing die station 210, this side curve can be eliminated by performing a differential stretching of one side of the metal strip with respect to the other side. As shown in FIG. 14, this is accomplished by canting the axis of the central pair of rotary dies 214 downwardly on the side of the strip which requires lengthening. Since the left side of the strip is shorter than the right side thereof, the side curve is eliminated by stretching the left side of the strip a greater amount than the right side. By canting the pair of parallel rotary dies 214 in the center of the equalizing die station 210, the force on the left edge of the strip becomes greater than the force on the right edge of the strip. Thus a greater amount of stretching of the left side than the right side will occur. This canting of the axis of the two central rotary dies 214 is readily accomplished by turning only one of the knurled heads 211G on the top of the die station 210.

Figure 15:
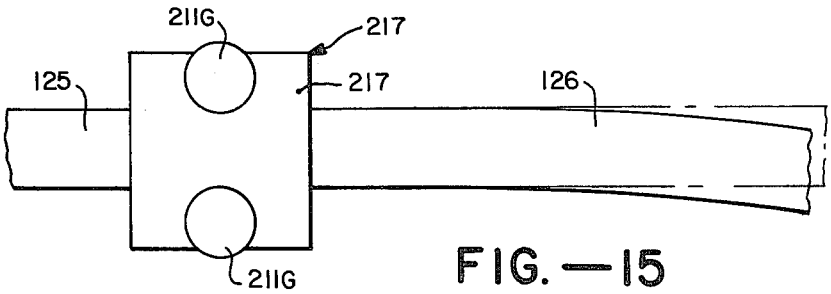
Figure 16:
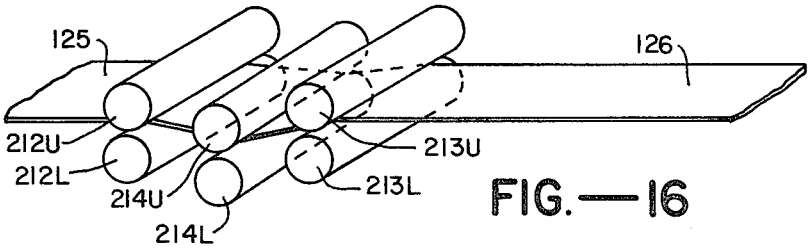

FIGS. 15 and 16 show the positioning of the central pair of rotary dies 214 to equalize out a side curve depicted in FIG. 15 where the right edge of the strip is shorter than the left edge of the strip. In this case, the central rotary dies 214 are canted opposite to that shown in FIG. 14 so that the right edge of the strip is stretched a controllably larger amount than the left edge of the strip. The differential amount of stretching at the edges can be controlled until the side curve is completely eliminated.

The equalizing die station 210 performs one additional function with respect to remanant memories in the thin metal strip passing therethrough. Generally, since the metal strip has been coiled, it will tend to have a remanant memory of a down curl. The controlled stretching of the metal strip in the equalizer die station tends to remove a substantial amount of this down curl from the strip so that when the strip is later cut into panels after forming the integral hinge members and the M-shaped corrugated profile, the strip will lie flat. As will later be seen, any remanant curl in the strip not equalized out in the equalizing die station 210 will be compensated for in the shaping-compensating die station in the next machine stage which is described below. However, by removing much of the down curve in the equalizer die station 210, the amount of compensation required in the next machine stage is reduced.

From the above description, it will be apparent that the main elements in a first machine stage of this inventive apparatus for producing metal drape panels having integral male and female hinge means formed thereon at preselected intervals and a preselected cross-sectional profile are the following:

rotary die means (170, 180; FIGS. 6 and 8) for cutting, at precisely spaced intervals, initial hinge patterns for successive pairs of male and female hinge means (123A, 123B; FIG. 7D) on a continuous strip of thin metal (120, 122; FIG. 7A) passing therethrough;

equalizing die means (210; FIGS. 6 and 9–14) for controllably stretching the strip as it passes therethrough to adjust the overall incremental distance between pairs of hinge patterns thereon; and driving means (230; FIG. 6) for pulling said continuous strip through said rotary die means and said equalizing die means while maintaining substantial tension in said strip as it passes through said die means.

Figure 1:
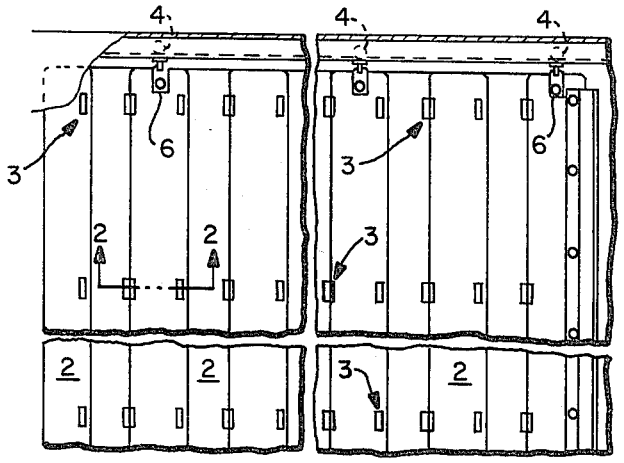
FIG. 1 is a front elevational view of a panel structure illustrative of the panels produced in accordance with this invention, with the panels transversed to an expanded position.
Figure 9:
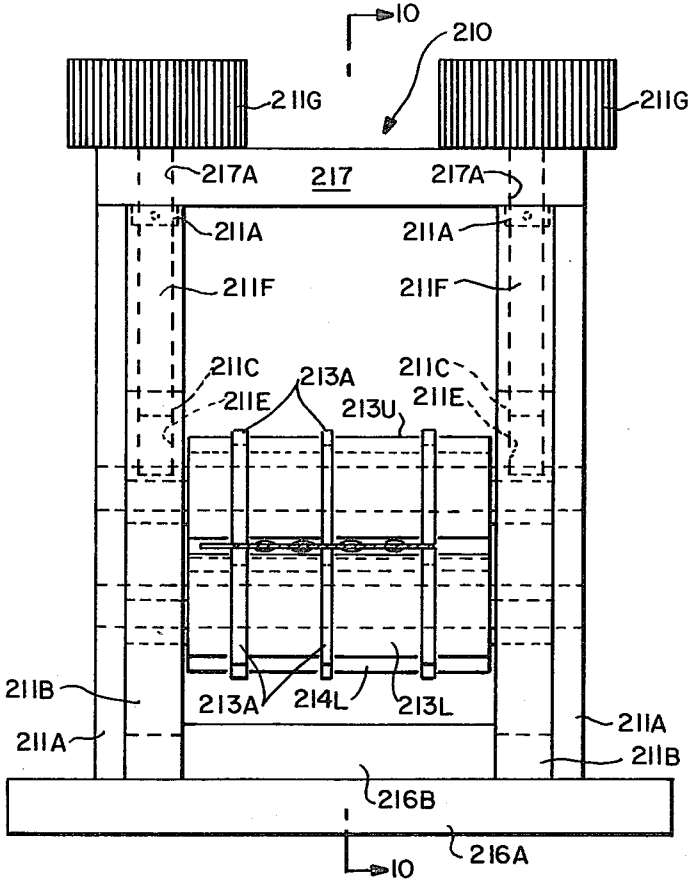
FIG. 9 is a front elevational view of an equalizing die station taken along the line 9—9 in FIG. 6.

Preferably, the equalizing die means (210; FIG. 6 and FIGS. 9–14) includes an adjustable die element 214; FIGS. 6 and 9–1, having two degrees of adjustment for simultaneously controlling the overall incremental distance between successive pairs of hinge patterns and, when required to remove a detected side curve in said continuous strip, to increase the length of one side of said strip with respect to the other.

While a preferred embodiment of the first machine stage 100 has been described in detail, it should be apparent that numerous modifications could be made therein by adopting alternative approaches to implementing certain of the machine functions provided therein. For example, an alternative arrangement of the various rotary die stations could be employed such that the embossing done at die station 160 in FIG. 6 could be performed after the rotary cutting dies at stations 170 and 180 have formed the initial hinge pattern. In addition, the scribing done at station 150 could be performed after the embossing performed at station 160 or weave pattern forming at station 200. However, the arrangement of rotary die stations depicted in FIG. 6 is believed to be the preferable one for several reasons. First, it is advantageous to perform several of the less important rotary die forming operations prior to the strip entering the rotary die cutting statfons 170 and 180 so that the strip will be in substantial tension when entering these cutting die stations. By having substantial tension on the strip, the horizontal position of the strip in passing through the rotary cutting dies at stations 170 and 180 can be more accurately maintained. Also, it is advantageous to have the weave pattern die station 200 immediately preceding the equalizing die station 210 for purposes of providing the maximum tension on the strip as it passes through the equalizing die station. The weave pattern dies at station 200 constitute a heavy load on the strip. Consequently, the tension in the strip section between the rotary weaving die station 200 and the equalizing die station 210 is substantially greater than at any previous point in the machine. This makes it easier for the rotary dies at equalizing die station 210 to perform their critical function of overall stretching of the strip and differential stretching of one side of the strip when necessary.

The resilient driving means 230 is one example of a useful type of driving apparatus for pulling the strip continuously through the rotary die stations. It should be apparent that other types of drive apparatus could also be used. For example, a driving wheel with a resilient tire having much larger diameter could be utilized with one or more resilient idler rollers spring biased into contact with it in order to provide a sufficient nonslip pulling drive for the continuous metal strip. However, the dual resilient drive wheel approach depicted in FIG. 6 is preferred, since it provide positive traction for the strip, it occupies only a small portion of the overall machine stage 100 and the complementary rolling of the strip in passing around the two drive wheels avoids putting any curl into the strip.

Figure 17:
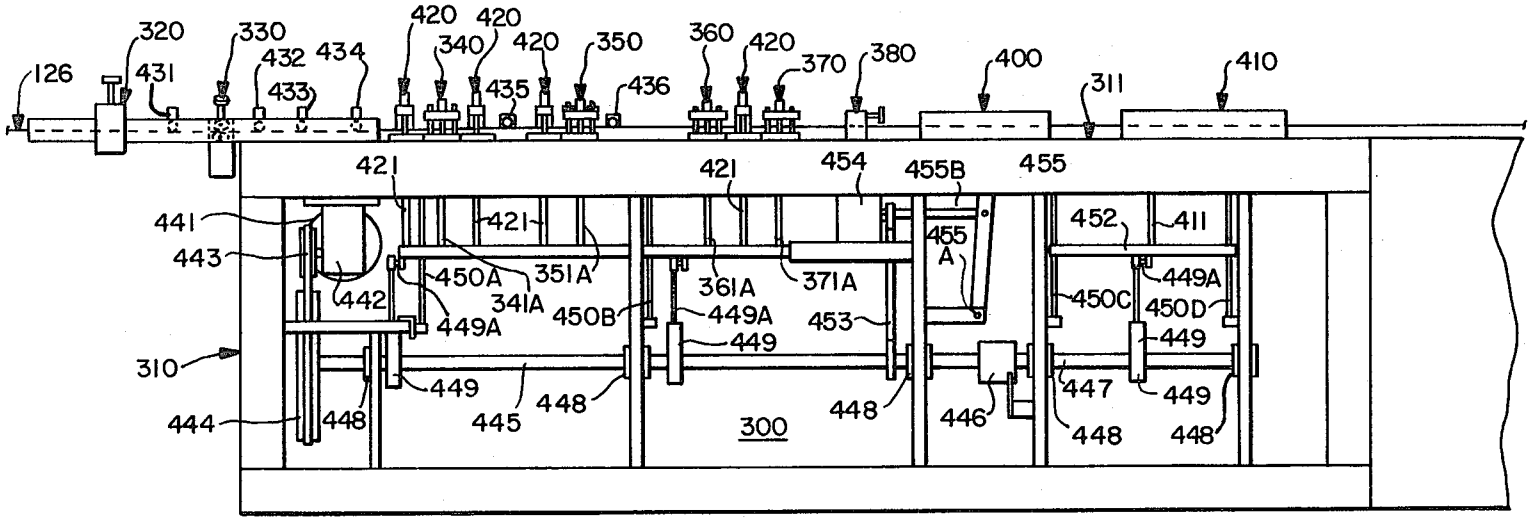
FIG. 17 is a schematic elevational view of a second machine stage for forming metal drape panels in accordance with this invention.
Figure 18:
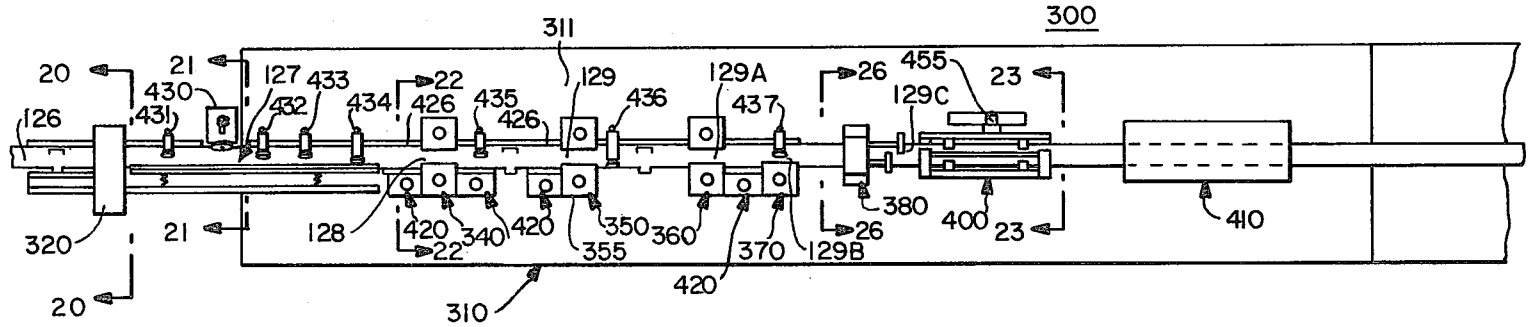
FIG. 18 is a schematic top view of the second machine stage depicted in FIG. 17.

After the strip passes out of the first machine stage 10, it may be stored temporarily on a take-up reel (not shown) or, alternatively, may be fed directly via interfacing idler rollers and take-up rollers to the second machine stage 300 which is depicted in FIGS. 17 and 18 whereat the remainder of the machine operations for forming a metal drape panel are performed.

Referring now to FIGS. 17 and 18, the structure and function of the second machine stage 300 of the apparatus of this invention will be described. Generally, the second machine stage 300 includes a reciprocating drive means 400, a second (back-up) equalizing die station 320, a rotary edge bending and corrugating die station 330, a sequence of punch die stations 340, 350, 360, and 370, a shaping-compensating die station 380, and a shearing die station 410.

Consider first the various forming operations that are performed at the various die stations shown in FIGS. 17 and 18. The metal strip 126 entering the second machine stage 300 is essentially in the form of strip section 125 shown in FIG. 7F. The second equalizing die station 320 is employed only if the first equalizing die station 210 in the first machine stage 100 depicted in FIG. 6 had not been properly operated to eliminate side curves from the metal strip. In other words, this second equalizing die station is a back-up equalizing die station which ordinarily will not come into play in second machine stage 300.

Figure 19A:
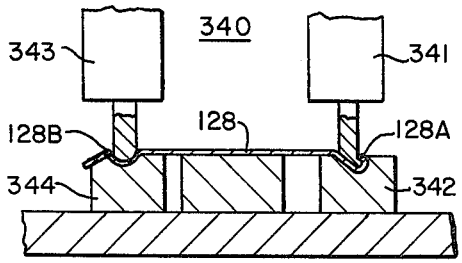
FIGS. 19A–19D are partly sectioned plan views showing the operations performed at various punch die stations in the apparatus shown in FIGS. 17 and 18.
Figure 21:
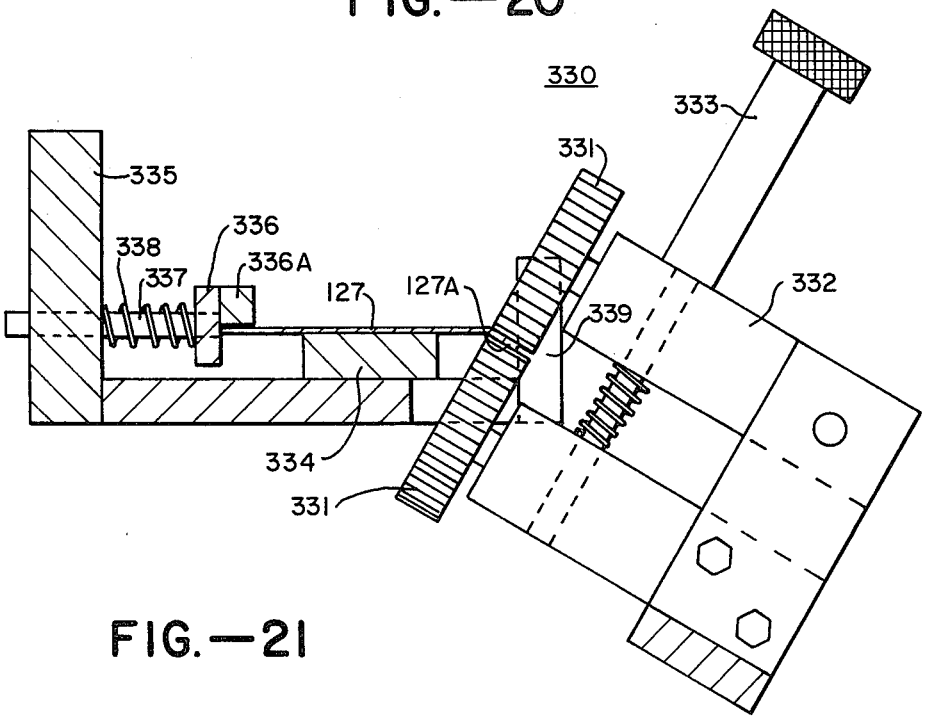
FIG. 21 is a plan view of an edge bending and corrugating die station taken along the line 21—21 in FIG. 18.

The rotary edge bending and corrugating die station 330 is depicted in greater detail in FIG. 21. The sole function of this die station is to bend the female hinge edge 127A downwardly and simultaneously to corrugate this edge to strengthen it. The structural details of this rotary die stage will be described later. The next die station encountered by the strip is the first punch die station 340 schematically illustrated in FIG. 19A. At punch die station 340, a male die element 341 and a female die element 342 cooperate to form an initial hook 128A on the male hinge tongue strip section 128. Simultaneously, a male die element 343 and female die element 344 cooperate to bend the tab 128B of the initial female hinge element into a rounded configuration as shown.

Figure 19B:
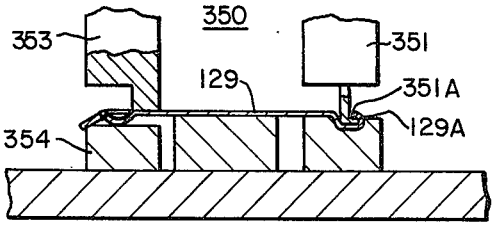

The next die station encountered by the strip is die station 350 depicted in FIG. 19B. At this punch die station, the strip segment 129 encounters a male die element 351 and female die element 352 which completes the formation of a hook on the male hinge tongue. Simultaneously, the male die element 353 and female die element 354 perform a further shaping of the female hinge tab.

Figure 19C:
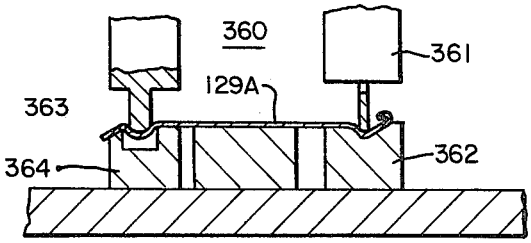

The next die station encountered by the strip is die station 360 depicted in FIG. 19C. At die station 360, a male die element 361 and female die element 362 cooperate to form a shoulder on the tongue of the male hinge means and set the angle of the male hinge means. Simultaneously, the male die element 363 and female die element 364 function to further shape the female hinge tab and place it in its final position.

Figure 19D:
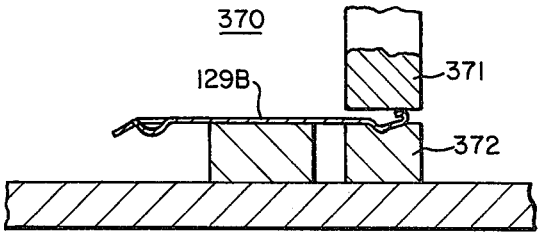

The next die station encountered by the strip is die station 370 depicted in FIG. 19D. At die station 370, a strip segment 129B encounters a male die element 371 and female die element 372 which cooperate together to push the hook on the male hinge means into its proper final position. At die station 370, there is no male and female die element for further forming of the female hinge tab since that female hinge tab has been completely formed at die station 360.

Figure 26:
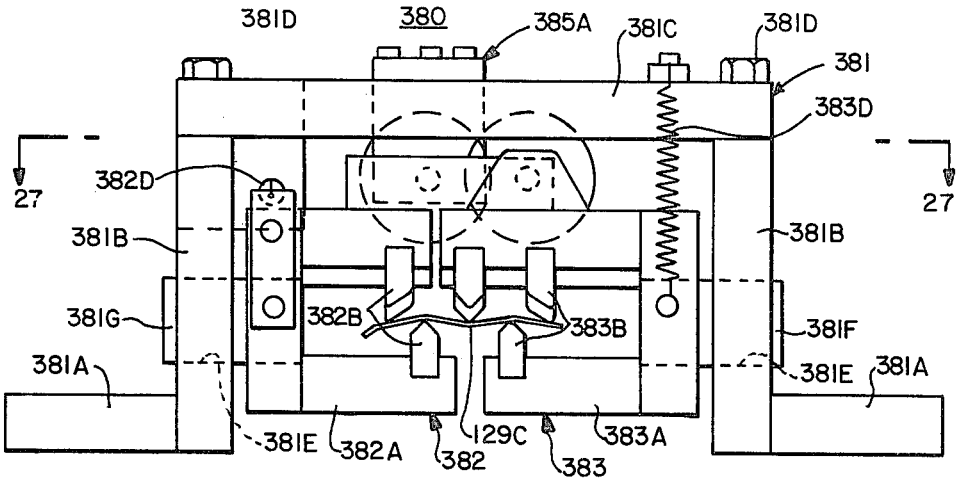
FIG. 26 is a plan view of shaping-compensating die means taken along the line 26—26 in FIG. 18.

The next die stage encountered by the strip is the shaping-compensating die station 380 which forms the strip into an M-shaped corrugated profile having the cross-sectional appearance of strip section 129C shown in FIG. 26. This is the final cross-sectional profile of the strip. The strip then encounters the reciprocal drive means 400 which pushes successive segments of the strip into the shearing die station 410 while pulling successive segments of the strip through prior die stations. Depending on the desired length of the final drape panel, shearing die 410 will operate after a prearranged number of steppings of the strip by the reciprocal drive means and then shear the strip. Two different shearing dies may be utilized either separately or together at the shearing die station 410 in order to control the length of the final drape panel and to cut the top and bottom thereof when necessary to maintain proper regulre spacing of the male and female hinge means along the length of the panel.

Figure 20:
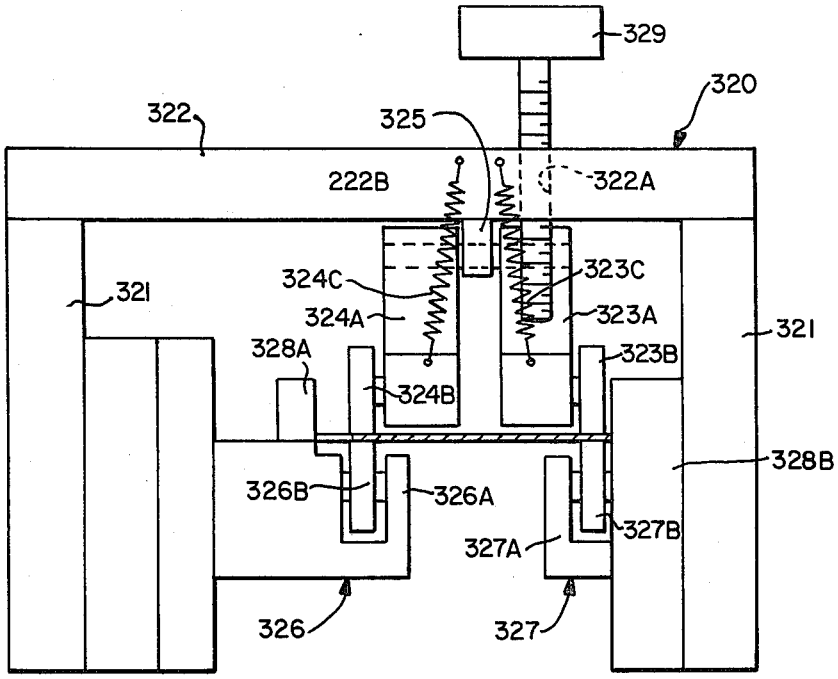
FIG. 20 is a plan view of a back-up equalizing die station taken along the line 20—20 in FIG. 18.

Having generally described the overall shaping functions of the various die stations in the second machine stage 300, some of the structural and functional details of the various die stations and other portions of the apparatus will now be described in detail. Consider first the back-up equalizing die station 320 depicted in greater detail in FIG. 20. This second equalizing die station 320 essentially comprises a die mounting cage consisting of a pair of vertical side supports 321 and a top support 322 having a pair of apertures 322A and 322B formed therein and tapped to selectively receive a thumbscrew 329. The thumbscrew 329 can alternately be threaded into the tapped hole 322A or tapped hole 322B. A support bracket 325 supports a pair of equalizing dies generally designated 323 and 324, each associated with one edge of strip 126. Each of the equalizing die elements 323, 324 is rotatably mounted on the bracket 325 such that the thumbscrew 329 can selectively push the die wheel 323B and 324B into contact with the edges of strip 126 and apply a controllable amount of pressure between the upper die wheels 323B, 324B and the lower die wheels 327B and 326B. These lower die wheels 326B and 327B are rotatably mounted on brackets 326A and 327A underneath strip 126. Depending on which side the previously unequalized side curve in strip 126 occurs, one of the sets of die wheels will be activated to apply pressure to one side of strip 126 or the other to grip that edge of the strip and, accordingly, stretch that edge as the strip is pulled therethrough by the reciprocating drive means 400 shown in FIGS. 17 and 18. The guide elements 328A and 328B position the strip 126 horizontally so that the rotary equalizing die wheel which is actuated at any point in time is properly in contact with the edge of the strip desired to be stretched. The springs 323C and 324C maintain the equalizing die elements 323 and 324 out of engagement with the strip except when pushed into engagement by the thumbscrew 329.

FIG. 21 depicts the structure of the rotary edge bending and corrugating die station 330. At die station 330, a pair of gear wheels 331 which are partly meshed produce both a bent female hinge edge 127A and a corrugation therein as the edge of the strip passes therethrough. Each of the rotary die wheels 331 is rotatably mounted at an appropriate angle of about 30 degrees by means of a mounting bracket generally designated 332. A screw adjustment 333 is provided for controlling the degree of engagement between the rotary die elements 331. This controls the depth of corrugation of the female hinge edge of the strip. Also, this adjustment on the engagement of the rotary die elements 331 can, to some extent, be utilized to remove a detected side curve when the female hinge edge of the strip is shorter than the male hinge edge of the strip. The scribe line which is the uppermost scribe line 121A shown in FIG. 7C enables a consistently straight bend to be made in the strip on this edge.

While passing through this rotary edge bending and corrugating die station, the strip section 127A rides on a horizontal guide surface 334. The horizontal position of strip 127 is maintained between a pair of guide rails 336 and 339. The guide rail 336 has a top lip 336A thereon which overrides the male hinge tab on the strip section 127. This guide element 336 is attached to a shaft 337 which is reciprocatingly mounted on support 335 and carries a compression spring 338 which lightly urges guide element 336 against the male hinge tongues on strip 127. As shown in FIG. 18, a plurality of spring loaded hold-down wheels 431 to 434 assist in keeping the strip 127 in a level horizontal position as it passes through the die station 330. Similar hold-down wheels 435-437, all of which are spring loaded to urge them into contact with the top of the strip, are provided at regular intervals for holding down the strip as it passes through the punch die stations 340, 350, 360, and 370.

Figure 22:
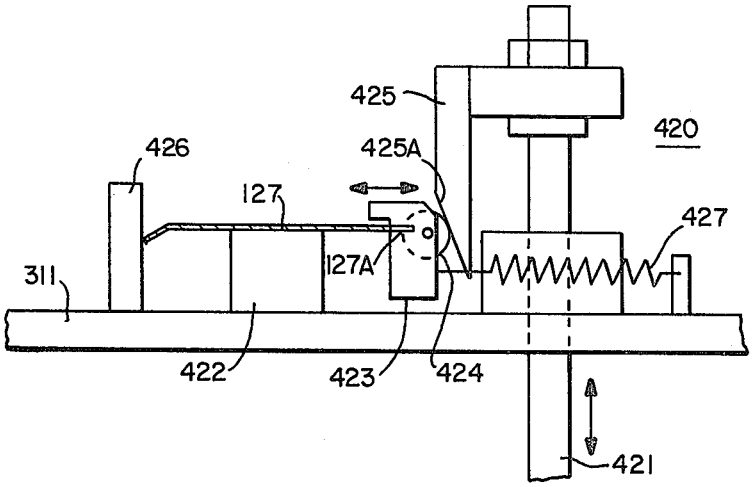
FIG. 22 is a schematic plan view depicting the operation of strip clamping apparatus and taken along the line 22—22 in FIG. 18.

At each of the punch die stations 340, 350, 360, and 370, one or more cam operated strip clamping means 420 are provided for gently clamping the strip against the edge guide 426 so that the strip will be properly positioned with the male and female hinge patterns between the die elements at the punch die stations. FIG. 22 depicts schematically the operation of the strip clamping means 420. A reciprocating clamping element 423 is mounted in a slidable fashion on the tabletop 311 with a tension spring 427 urging the clamping element 423 away from the strip 127. When the cam actuator 425 is in a raised position, the clamping element 423 is positioned away from the strip 127 to enable the male hinge tongue 127A on the strip to pass freely to the next punch die station. However, when the cam actuator 425 is pulled down, the anvil portion 425A progressively engages the rotary cam wheel 424 on the clamping element 423 and urges the clamping element 423 into engagement with the male hinge edge of strip 127. This gently clamps strip 127 between the clamping element 423 and the guide element 426 to ensure that the male and female hinge patterns are properly located horizontally with respect to the punch die elements so that the male and female hinge means can be accurately formed at the various punch die stations. The cam actuator 425 is driven by means of a driving rod 421 which is operated by a driving-timing apparatus which is generally depicted in FIG. 17 and will be described in detail later. Comparing FIG. 22 with FIGS. 19A-19D, it should be understood that the clamping element 423 is moving in to clamp strip 127 at the same time that the various male die elements depicted in FIGS. 19A-19D are coming down to do the forming operations on the male and female hinge patterns previously cut into the metal strip.

The constructional details of most of the various punch die stations shown schematically in FIGS. 19A–19D need not be described in detail since they are of relatively standard, straightforward construction. The only special punch die apparatus is the male hinge forming die 355 at die station 350 (FIG. 17). Since the male die element 351 (FIG. 19B) is utilized to form a hook over a mandrel 351A on the die element, it is preferable not to raise the male die element 351 very far since that would tend to destroy the hook 129A formed by the die. Consequently, this die 355 is constructed such that the male die element 351 raises only a small amount and picks up the hooked male hinge tongue 129A with it, while maintaining engagement therebetween. Accordingly, punch die 355 has associated with it a vertical stop against which the die element is urged by a spring labeled 355 in FIG. 17. Accordingly, as the drive rod 351A associated with punch die 355 is lifted vertically, the male die element 351 is precluded from raising more than about a quarter of an inch and carries the male hinge hook with it. Thereafter, when the reciprocating drive means 400 steps the strip, the the male hinge hook 129A slides off the die mandrel 351A on male die element 351 and retains its hook shape.

As will be noted from FIG. 18, assuming the male and female hinge means have a preselected interval of six inches, the die stations 40, 350, and 360 are spaced at twelve-inch intervals and the die station 370 is spaced at a six-inch interval from die station 360. Spacing the first two punch die stations 340 and 350 by a distance equal to twice the preselected hinge interval provides more room for positioning the strip clamping apparatus 420 to provide a more positive positioning of the strip at the most critical punch die station 340. Punch die station 360 could probably be located only six inches from punch die station 350 without any deleterious effect on the die forming operations carried on thereat, but it is convenient to maintain the first three die stations at regular twelve-inch intervals.

Figure 23:
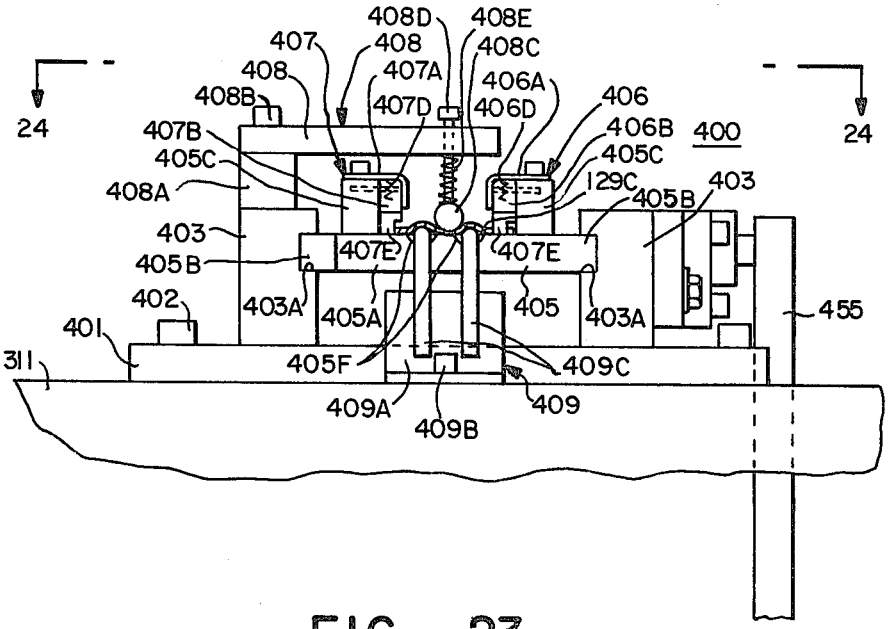
FIG. 23 is a plan view of receiprocating drive means taken along the line 23—23 in FIG. 18.
Figure 24:
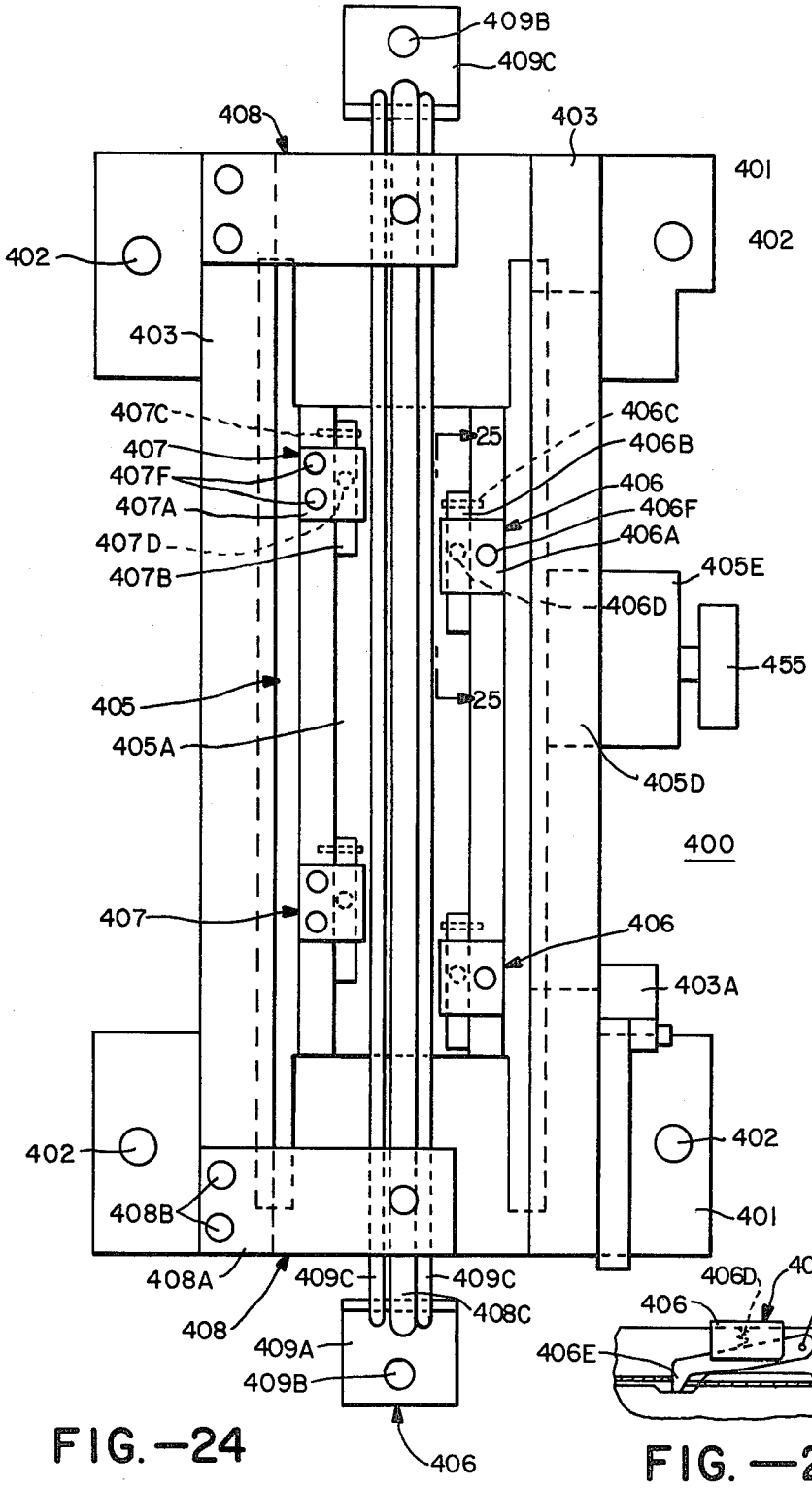
FIG. 24 is a top view of reciprocating drive means taken along the line 24—24 in FIG. 23.
Figure 25:
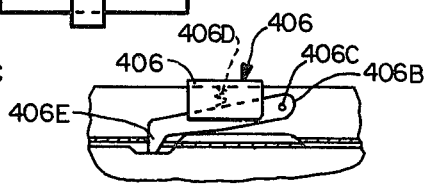
FIG. 25 is a partial elevational view of a driving pawl mechanism taken along the lines 25—25 in FIG. 24.

Referring now to FIGS. 23–25, the structure and function of the reciprocating drive means 400 will be described. The main elements of reciprocating drive means 400 are the following:

- a reciprocating strip driving table 405;
- a pair of table mounting brackets 403 which carry the reciprocating drive table in a slidable fashion;
- a pair of base plates 401 for mounting the drive table mounting brackets 403 to the tabletop 311 of the second machine stage 300;
- a pair of female hinge driving pawl mechanisms 406 carried on drive table 405;
- a pair of male hinge driving pawl mechanisms 407 carried on drive table 405;
- a strip hold-down mechanism 408; and
- a strip guide bracket 409.

The two base plates 401 are mounted to tabletop 311 by means of any appropriate fastening device such as bolts 402. The drive table mounting brackets 403 are vertical support walls each having an inwardly disposed groove 43A which receives a cooperating tongue 405B on drive table 405. In this fashion, drive table 405 is able to slide longitudinally in the grooves 403A. A slit 403B is provided in one of the vertical drive table mounting brackets to receive a bracket drive arm 405D which couples a table driving block 405E to the main body 405 of drive table 405. As shown in FIG. 24, the drive block 405E is connected to a drive arm 455, the operation of which will be described in more detail later in connection with the timing-driving apparatus shown in FIG. 17. The drive table mounting bracket 403 carries a stop block 403A which provides a positive stopping position for the table drive block 405E. The horizontal drive table 405A carries a pair of vertical supports 405C for the male and female hinge driving pawl mechanisms 406 and 407.

The male and female hinge driving pawl mechanism 406 and 407 are essentially identical in structure and can best be seen by considering FIG. 25 in conjunction with FIGS. 23 and 24. Only the female hinge driving pawl mechanism 406 will be described with comparable features of the male hinge driving pawl mechanism identified by a similar sequence of reference numbers. A bracket 406A is mounted on vertical support 405C both to confine the driving pawl 406B at the edge of the support 405C and to retain compression spring 406D which operates to urge pawl 406 into engagement with the edge of the female hinge means. A pin 496C extending through pawl 406B provides a pivot point for pawl 406B. Accordingly, pawl 406B is free to rotate upward out of engagement with the female hinge means as the reciprocating drive table 405 is withdrawn in a backwards step after taking a driving step forward. The driving end 406E on pawl 406B is designed to come to a point with a vertical front edge to engage the open edge of a female hinge means and with a slanted rear portion to enable the driving end of the pawl to slidably withdraw its engagement with the female hinge means.

The function of the reciprocating drive table 405 with the hinge driving pawl mechanisms 406, 407 carried thereon is to engage two sets of male and female hinge means on a strip so that as the drive table steps forward, the strip 129C will be stepped forward by an amount precisely equal to the preselected interval between pairs of hinge means. Thereafter, the table will step back and the driving pawls disengage from the hinge means until they engage again with the next set of hinge means. Generally, the drive table may take a backwards step longer than the hinge interval and then while driving forward engage the male and female hinge means with the driving pawls to drive the strip again the incremental distance. The position of stop block 403A is set such that the strip will come to rest in a position where the initial hinge patterns are precisely located at the various punch die stations.

The strip hold-down mechanism 408 cooperates with the strip guide bracket 409 to maintain the strip 129C shown in FIG. 23 in a positively guided horizontal position so that the driving pawls 406, 407 will properly engage the male and female hinge means. The strip holddown mechanism 408 includes a bracket 408A which is mounted by means of a fastening bolt 408B to the drive table bracket 403. A pair of these strip hold-down brackets 408A is provided, one at each end of the table mounting bracket 403. The hold-down arm 408C of the hold-down mechanism 408 is mounted on bolts 408D which extend through an aperture in the cantilevered section of the mounting brackets 408A. A compression spring 408E urges the hold-down arm 408C lightly against the top of strip 129C.

Strip guide bracket 409 comprises a pair of base mounting elements 409A at each end thereof which are fastened to tabletop 311 by means of screws 409B or other appropriate fastening means. A pair of guide arms 409C are fastened to the base elements 409A by any appropriate means such as welding. A pair of grooves 405F are provided in the reciprocating table 405 to receive a lower portion of the generally circular guide arms 409C. In this fashion, tne drive table is free to reciprocate with respect to the stationary strip guide arms 409C. The location of the strip guide arms 409C is determined by the pattern of the M-shaped corrugation in strip 129C. Referring to FIG. 23, it can readily be seen that the strip 129C is slidably guided by the strip hold-down arm 408C and the two guide bracket arms 409C. Consequently, as the driving table 405 reciprocates with the driving pawls 406, 407 engaged with the male and female hinge means, the strip 129C will slide with respect to the guide bracket arms 409C and the hold-down arm 408C. Relatively light pressure is maintained by the hold-down arm 408C in order to enable the strip 129C to slide freely without marring any painted surface thereon. Of course, the surfaces of hold-down arm 408C and guide bracket arms 409C shoul be very smooth and free of burrs in order to avoid scratching the paint off of strip 129C as it slides in relation to these elements.

From the above description, it will be apparent that the reciprocating drive means 400 functions to accurately step the metal strip exiting the shaping-compensating die station 380 shown in FIGS. 17 and 18 through a precise incremental distance equal to the preselected interval between hinge means. With this accurate stepping drive of the strip, the initial hinge patterns and partially formed hinge means in the strip will be accurately located with respect to the punch die stations 340, 350, 360, and 370, so that these punch die stations can accurately form the final configurations of the male and female hinge means. There are, of course, many alternative approaches to a reciprocating drive means 400. For example, the driving table could be located above the strip instead of below it. It would be possible to use only a single pair of male and female hinge driving pawl mechanisms 406, 407 instead of the four provided in the exemplary apparatus but four mechanisms provide a preferable safety factor in driving the strip should one of the pawls get hung up or otherwise malfunction.

Figure 27:
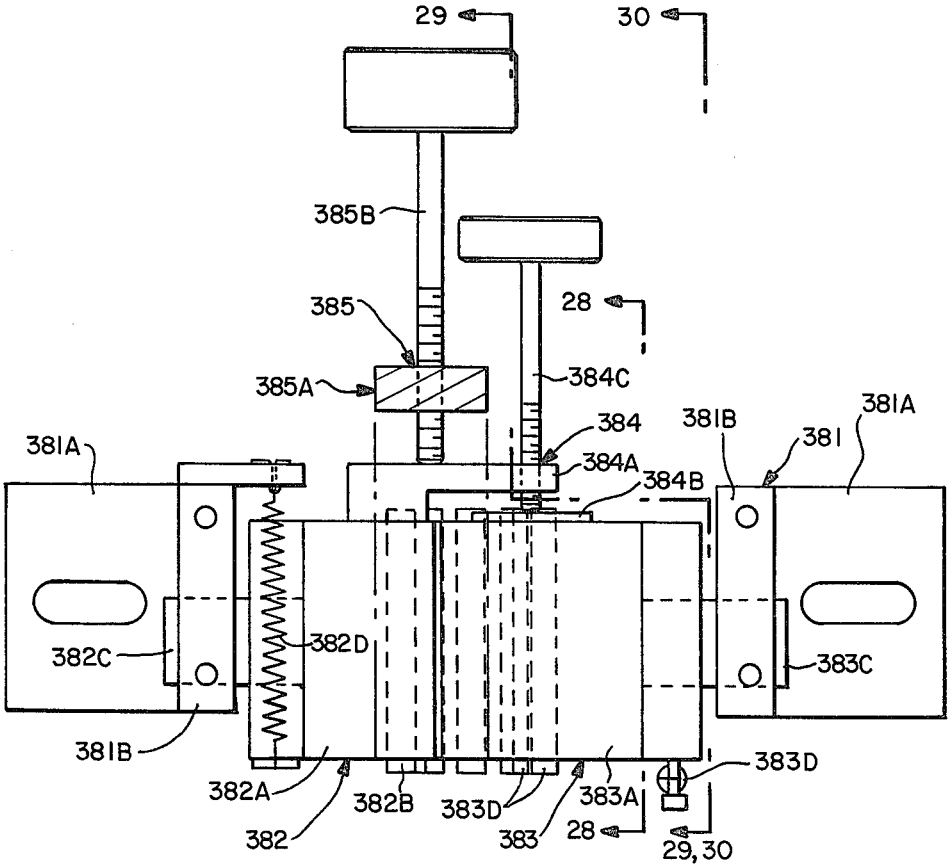
FIG. 27 is a partly sectioned top view of shaping-compensating die means taken along the line 27—27 in FIG. 26.

Referring now to FIGS. 26–30, the structure and function of the shaping-compensating die station 380 depicted in FIG. 17 will be described. FIGS. 26 and 27 generally depict the elements of the shaping-compensating die apparatus. These essential elements are the following:

- a first shaping die section 382;
- a second shaping die section 383;
- a bracket type means 381 for mounting each of the shaping die sections 382, 383 for individual rotation about a common transverse axis defined by the shafts 381F and 381G;
- a positioning means 384 for varying the rotational position of die section 383 with respect to die section 382; and
- a positioning means 385 for jointly varing the rotational position of both die section 382 and die section 383.

The die mounting bracket 381 includes a pair of base plates 381A which mount on the tabletop 311 of the second machine stage 300 shown in FIG. 17. Any appropriate fastening means such as a pair of bolts can be utilized to fasten mounting bracket 381 on the tabletop. A pair of vertical side supports 381B and a horizontal top support 381C complete the bracket 381. Each of the shaping die sections 382 and 383 consist essentially of a C-shaped die bracket 382A, 383A with a plurality of upwardly and downwardly extending die teeth 382B, 383B mounted therein. These die teeth together perform the function of shaping a flat metal strip into a corrugated profile having an M-shape. Shaping die section 382 is rotatably mounted on one of the vertical side support 381B by means of a shaft 381G received in an aperture 381E. A bushing (not shown) may be utilized in the aperture 381E. Die section 383 is rotatably mounted separately in the other vertical side support 381B by means of a shaft 381F received in aperture 381E. Consequently, each of the die sections 82, 383 is separately rotatable about a common transverse axis.

Figure 28:
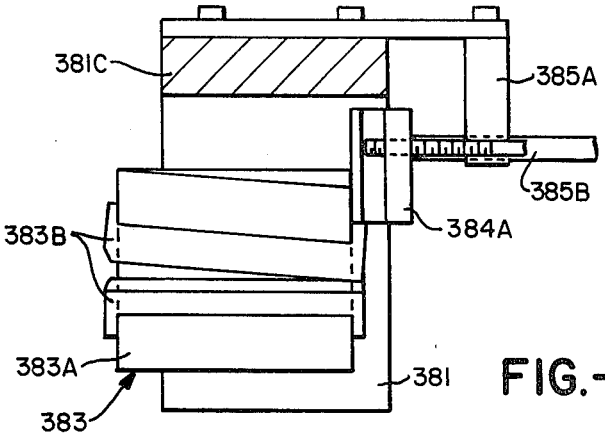
FIG. 28 is a partial section view of shaping-compensating die means taken along the line 28—28 in FIG. 27.

Referring now to FIG. 28, it can be seen that the respective C-shaped brackets 383A (382A) have the top portion of the bracket canted from front to rear so as to provide a lead-in taper for the strip of metal passing between the die teeth 383B (382B). Thus, the M-shaped cross section is gradually formed as the strip of metal is pulled through the die by the recriprocating drive means 400 depicted in FIG. 17.

Figure 30:
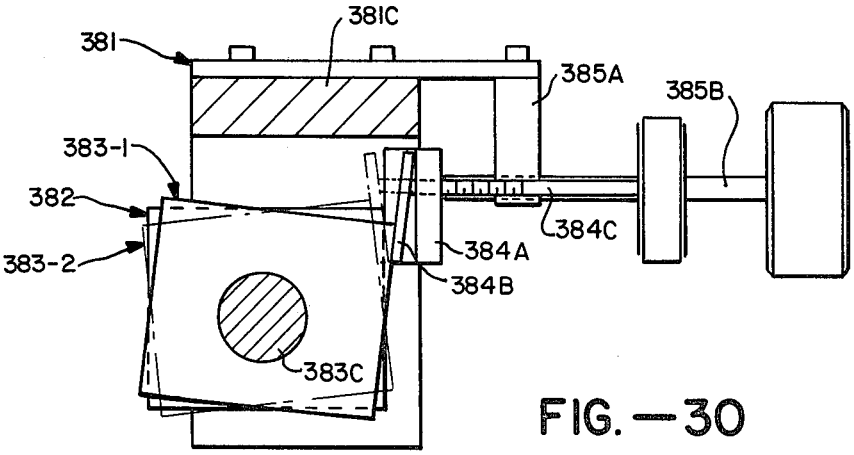
FIG. 30 is a partly sectioned view of shaping-compensating die means taken along the line 30—30 in FIG. 27.

Referring to FIG. 27 in conjunction with FIG. 30, it will first be described how the rotational position of die section 383 may be altered with respect to die section 382. As shown in FIG. 27, bracket 384A is physically attached to die section 382 and a thumbscrew 384C extends through a threaded aperture in bracket 384A to contact a plate 384B attached to die section 383. As shown in FIG. 30, the position of the end of thumbscrew 384C will control the relative position of plate 384B mounted on die section 383 with respect to the position of bracket 384A. Consequently, as thumbscrew 384C is turned further through bracket 384A, the distance between plate 384B and the bracket 384A will increase and die section 383 will rotate counterclockwise on shaft 383C to lower the strip entrance end of die section 383 with respect to the strip entrance end of die section 382. Correspondingly, as the thumbscrew 384C is withdrawn through the aperture in bracket 384A, the die section 383 will rotate in a clockwise direction until the strip entrance end of bracket 383 is higher than the strip entrance end of die section 382. Spring 383D is a tension spring which urges die section 383 and plate 384B against the end of thumbscrew 384.

Figure 29:
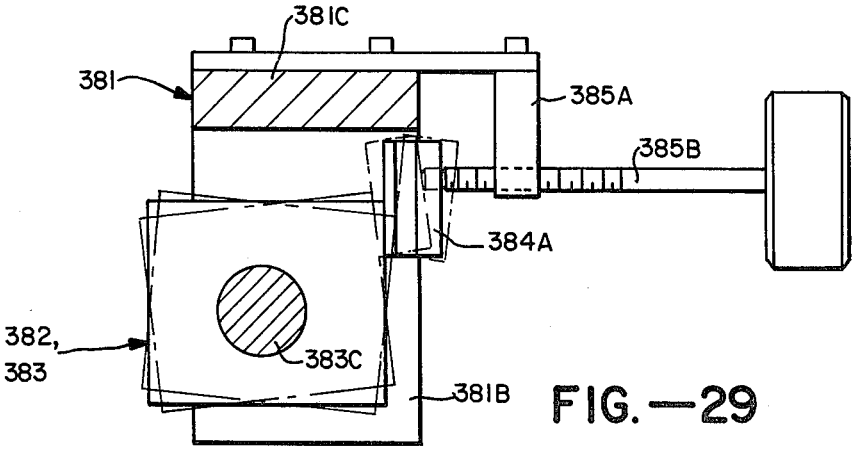
FIG. 29 is a partial section view of shaping-compensating die means taken along the line 29—29 in FIG. 27.

Referring to FIGS. 27 and 29, it will be seen that the overall rotational position of both die sections 382 and 383 can be jointly varied by the operation of thumbscrew 385B. Bracket 385A is rigidly mounted to the die mounting bracket 381. Consequently, as the end of thumbscrew 385B adjusts the position of bracket 384A, both die sections 382 and 383 will rotate together on their respective shafts. By controlling the position of the end of thumbscrew 385B with respect to bracket 385A, the rotational position of both die sections can be simultaneously changed. Tensions spring 382D urges die section 382 (with bracket 384A) and die section 383 jointly against the end of thumbscrew 385B. Dampening means (not shown) are preferably provided for thumbscrew 385B to preclude an unwanted shift in its position due to vibration as the second machine stage operation.

The function of shaping-compensating die station 400 to produce an M-shaped cross-sectional profile in a strip passing therethrough is apparent from the view of this die station given in FIG. 26. While this is an important function of this shaping-compensating die station 400, another important function thereof involves manipulating the rotational positions of the individual die sections 382 and 383 to remove any detected curl and/or twist in the strip of metal passing through the die station. Consider, for example, a strip of metal which has an upward curl which is detected in the first test panel passing through the second machine stage 300. To remove an upward curl, the die sections 382 and 393 would together be rotated using thumbscrew 385B in a counterclockwise manner (according to the view shown in FIG. 29) so that the lower die teeth in both die sections would exert upward pressure on the strip of material as it exits the shaping-compensating die station. This would tend to reverse the upward curl and straighten the strip. The converse adjustment would be provided if the initial test strip had a detected down curl. In such a case, the thumbscrew 385B would be operated to tilt the die sections 382 and 383 in a clockwise direction so that the strip exiting the shaping-equalizing die station would have a downward force applied by the upper die teeth. This tends to curl the strip in an upward fashion and thereby removes a previous down curl.

If the test strip passing through the second machine stage 300 has a twist to it, depending on the direction of the twist, the thumbscrew 384C may be adjusted to change the rotational position of die section 383 with respect to die section 382. By producing the appropriate differential compensating curl between one portion of the strip and the other, an inherent curl in the strip material passing through the shaping-equalizing die station 380 can be eliminated.

This shaping-equalizing die station 380 performs a vital function in enabling the manufacturer of individual metal drape panels which are completely straight and, when assembled together into a final drape assembly, will produce an overall multi-panel drape which is fee of any curves or bows and operates freely without binding.

Referring back to FIG. 17, the common timing drive apparatus 440 for the second machine stage will be briefly described. It will be appreciated that accurate synchronous timing is required between the operation of the reciprocating drive means 400 and the vertical punch die stations 340, 350, 360, and 370. The reciprocating drive means 400 must step the strip an incremental distance between female and male hinge means while the punch dies at these die stations are at or near the top of their stroke, and the punch dies must complete their forming operations on the male and female hinge means and return to a released vertical position prior to another reciprocating step of the strip. To accomplish this synchronized timing-driving function, the vertical driving motion for the various punch die stations and the horizontal driving motion for the reciprocating drive means 400 is provided from a common drive shaft 445 which is turned by a flywheel 444. Flywheel 444 is turned by a belt drive arrangement 443 from a gear box 442, which in turn is driven by an electric motor 441. The common drive shaft 445 is mounted on a pair of vertical support braces by means of bearings 448. A common drive table 451 is employed for all of the drive rods 341A, 351A, 361A, and 371A associated with the punch die stations 340, 350, 360, and 370, and the drive rods 421 for the strip clamping stations 420. Drive table 451 is mounted in a vertical reciprocating fashion on a pair of slide shafts 450A and 450B. The driving force for driving table 451 is provided by a pair of eccentrics 449 mounted on shaft 445 and attache to drive table 451 by way of ounting arrangements 449A. Consequently, as drive shaft 445 turns, drive table 451 will be driven down and back up a prearranged distance with each revolution of drive shaft 445.

To operate the reciprocating drive means 400, a gear box 454 is coupled to drive shaft 445 via a chain arrangement 453. Gear box 454 translates the rotating motion of the drive shaft 445 trasmitted through the chain arrangement 453 into a rotary motion in the plane of the arm 455 which is mounted in a pivoting fashion at 455A. The coupling arm 455B is attached to an eccentric wheel (not shown) or rotating arm (not shown) mounted on the shaft (not shown) of gear box 454 such that the eccentric wheel or rotating arm will revolve once with each revolution of drive shaft 445. This drives the arm 455 through one reciprocating cycle with each revolution of shaft 445. The position of the drive for the arm 455 is preset with respect to the required timing relation between the reciprocating drive means 400 and the punch dies at punch die stations 340, 350, 360, and 370 so that the strip will be travelling under the pull of the reciprocating drive means 400 while the punch dies are out of engagement with the strip, and the strip will be stationary with the table of the reciprocating drive means moving backward while the punch dies are coming down to do their forming operations on the strip. Then as the dies are pushed up by the drive table 451, the drive arm 455 will be pushed forward by the gear box 454 to again drive the strip the incremental distance between hinge means.

To drive the shearing die station 410, a clutch arrangement 446 is utilized to couple the main drive shaft 445 to a second drive shaft 447 which is mounted in bearings 448. Clutch 446 is selectively engagable at the time a shearing action is desired. Selective engagement of clutch 446 can be provided either by a manual switching arrangement or by a detector which signals that the strip has reached the length desired for action of the shearing dies at shearing die station 410. At such time as the clutch 46 is engaged, the shaft 447 will rotate with shaft 445. An eccentric 449 on shaft 447 will operate a drive table 452 which operates the shearing dies through drive rods 411. Drive table 452 is mounted for up and down reciprocation on slide arms 450C and 450D. Eccentric 449 is mounted to drive table via a mounting arrangemnt 449A.

It will be appreciated by those skilled in the punch press art that various other types of synchronized driving arrangements could be provided for the second machine stage 300.

Having described both the first machine stage 100 (FIG. 6) and the second machine stage 300 (FIGS. 17 and 18) in accordance with this invention, we will now consider the initial setup of these machine stages and the various ways in which they can be interfaced such that the strip exiting the first machine stage 100 shown in FIG. 6 can be fed to second machine stage shown in FIGS. 17 and 18.

Figure 31:
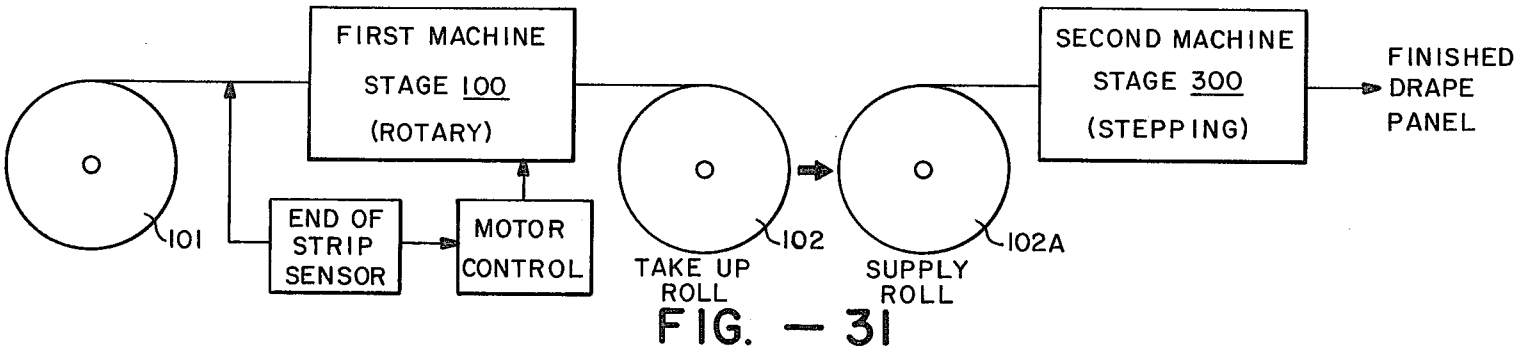
FIG. 31 is a schematic diagram of one arrangement of the first and second machine stages in accordance with this invention.

FIG. 31 shows one approach to interfacing first machine stage 100 and second machine stage 300. The approach shown in FIG. 31 involves physically separating the feeding of the two machine stages utilizing a supply roll 101 and take-up roll 102 with respect to the first machine stage 100 such that it may run continuously. The take-up roll 102 for the first machine stage 100 becomes the supply roll 102A for the second machine stage 300. It is preferable for first machine stage 100 to operate on a continuous strip since it is a time-consuming process to thread the strip through the rotary die stations therein. To accomplish this, the first machine stage 100 is automatically stopped when the end of the strip on supply roll 101 is detected by an end-of-strip sensor 102. End-of-strip sensor 102 detects the end of the strip on the supply roll well in advance of the last incremental section of the strip entering the first die station such that an output signal from the end-of-strip sensor 102 can be coupled to motor control 103 to turn off the motor 231 in drive means 230 shown in FIG. 6. Then a new supply roll can be provided and the front section of the new strip may be stapled to the back section of the previous strip to maintain continuity in the strip material passing through the first machine stage 100. However, each time a new supply roll of strip material is provided, the machine must be run a short distance and then the full take-up roll must be changed.

Consider now the initial threading of the first machine stage 100. Basically, this initial threading of the strip into the various rotary die stations depicted in FIG. 6 is accomplished by hand feeding the strip into the various die stations and, where necessary, utilizing a hand-operated wheel to drive the shafts of the rotary die stations to pull the strip through each station. Once the strip is threaded through all of the rotary die stations and through the resilient drive means 230, it is attached to the take-up roll 102. Since each new supply roll of strip material has its own individual remanant memory characteristics, the equalizing die station 210 must typically be adjusted for each new supply roll. This is accomplished by running a test section of strip from the roll through the first machine stage 100 and then inspecting and gaging the test section to determine whether adjustments in the equalizing die station 210 need to be made. One of the tests made is to gauge the intervals between the initial hinge patterns formed on the strip in the first machine stage to determine whether the strip needs to be either lengthened or shortened to produce the required initial hinge pattern interval. A metal hinge pattern gauge may be laid against the test strip to determine whether the hinge patterns are at the right interval or not. If the initial hinge pattern intervals are too long, the pair of rotary dies 214 may be raised to reduce the stretching of the strip. If the intervals are too short, the rotary dies 214 may be lowered to increase the stretching of the strip.

By either cutting off an initial segment of the strip from the new supply roll after passing through the first machine stage 100 or by simply sighting along the strip after it leaves the drive means 230, any side curves in the strip can be visually detected. If a side curve is detected, then the equalizing die station 210 is adjusted via knurled thumbscrews 215 to increase stretching force on one side of the strip or the other to eliminate the side curve.

Initial threading of the second machine stage 300 from a supply roll 102A coming off of the first machine stage 100 is a relatively simple operation. Referring to FIGS. 17 and 18, the strip is simply hand fed through the punch die stations and through the shaping-compensating die station 380 until the first two sets of initial male and female hinge patterns are in position to be engaged by the driving pawls on the reciprocating drive means 400. Thereafter, a test panel may be made by operating the second machine stage until a first complete panel is formed. Thereafter, this first panel is tested by holding it vertically and visually inspecting it to determine whether any curl or twist exists in the strip. If any curl or twist is detected, the shaping-compensating die station 380 is adjusted in an appropriate manner as previously described in order to eliminate the detected curl or twisting of the strip. In the event that a side curve is detected in the finished panel at this point, the back-up equalizing die station 320 must be utilized to eliminate the side curve so that the finished drape panels coming out of shearing die station 410 will be completely straight. Each time a new supply roll 102 is provided for the second machine stage 300, the test panel must be run to determine whether the shaping-compensating die station 380 must be adjusted to eliminate curl or twist in the finished panels.

Figure 32:
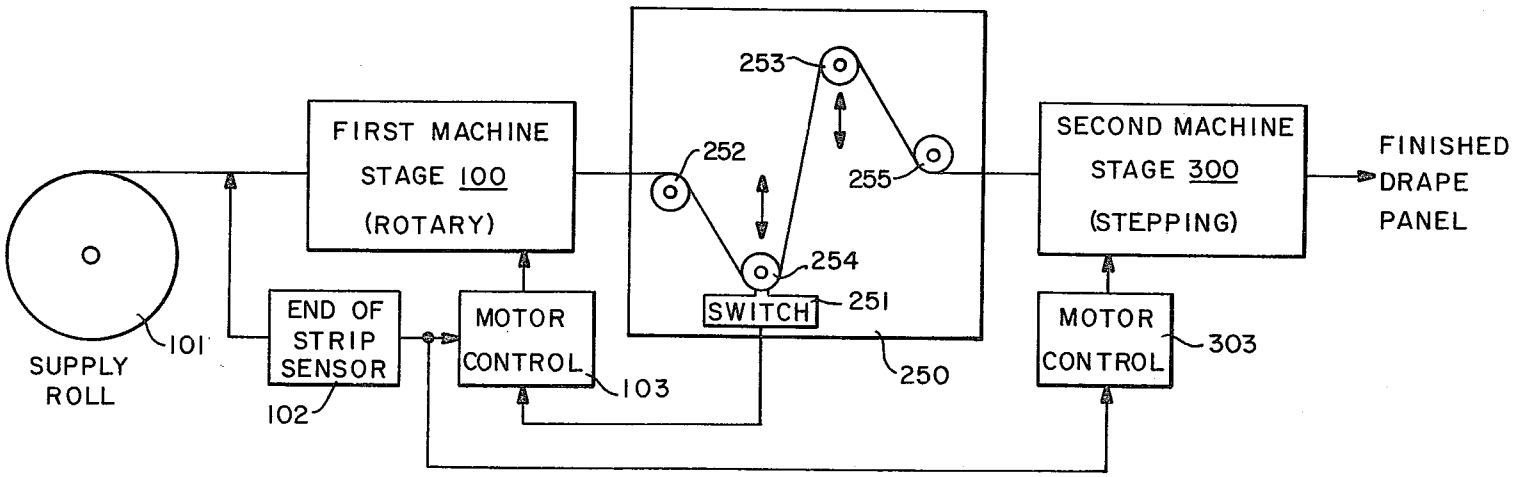
FIG. 32 is a schematic diagram of an alternative arrangement of the first and second machine stages in accordance with this invention.

Referring now to FIG. 32 an alternative approach to interfacing the first machine stage 100 and the second machine stage 300 is depicted. Instead of utilizing a take-up roll for the first machine stage, the strip coming out of that machine stage is fed through a interfacing set of rollers and directly into the second machine stage 300. The interfacing apparatus 250 may include a pair of idler rollers 252 and 255 which simply guide the strip into a pair of length compensating rollers 253 and 254. The length compensating rollers 253 and 254 will be spring loaded to maintain a moderate amount of tension on the strip and will be mounted such that their vertical positions can change as changing lengths of strip accumulate in the interface section 250. In this fashion, the first machine stage 100 can operate at a faster speed than the second machine stage 300 and simply be turned on and off by the switch 251 when excess strip has accumulated in the interface stage 250. In this approach, the end-of-strip sensor 102 associated with the first machine stage 100 will also control motor control 303 in conjunction with second machine stage 30 so that the second machine stage will stop along with the first machine stage when the end of a strip from a particular supply roll 11 is detected. Of course, using the approach depicted in FIG. 32 does not avoid the necessity of testing the initial sections of each new supply roll exiting both the first machine stage and the second machine stage in order to properly adjust the equalizing die station 210 in the first machine stage and the shaping-compensating die station 380 in the second machine stage 300.

Figure 33:
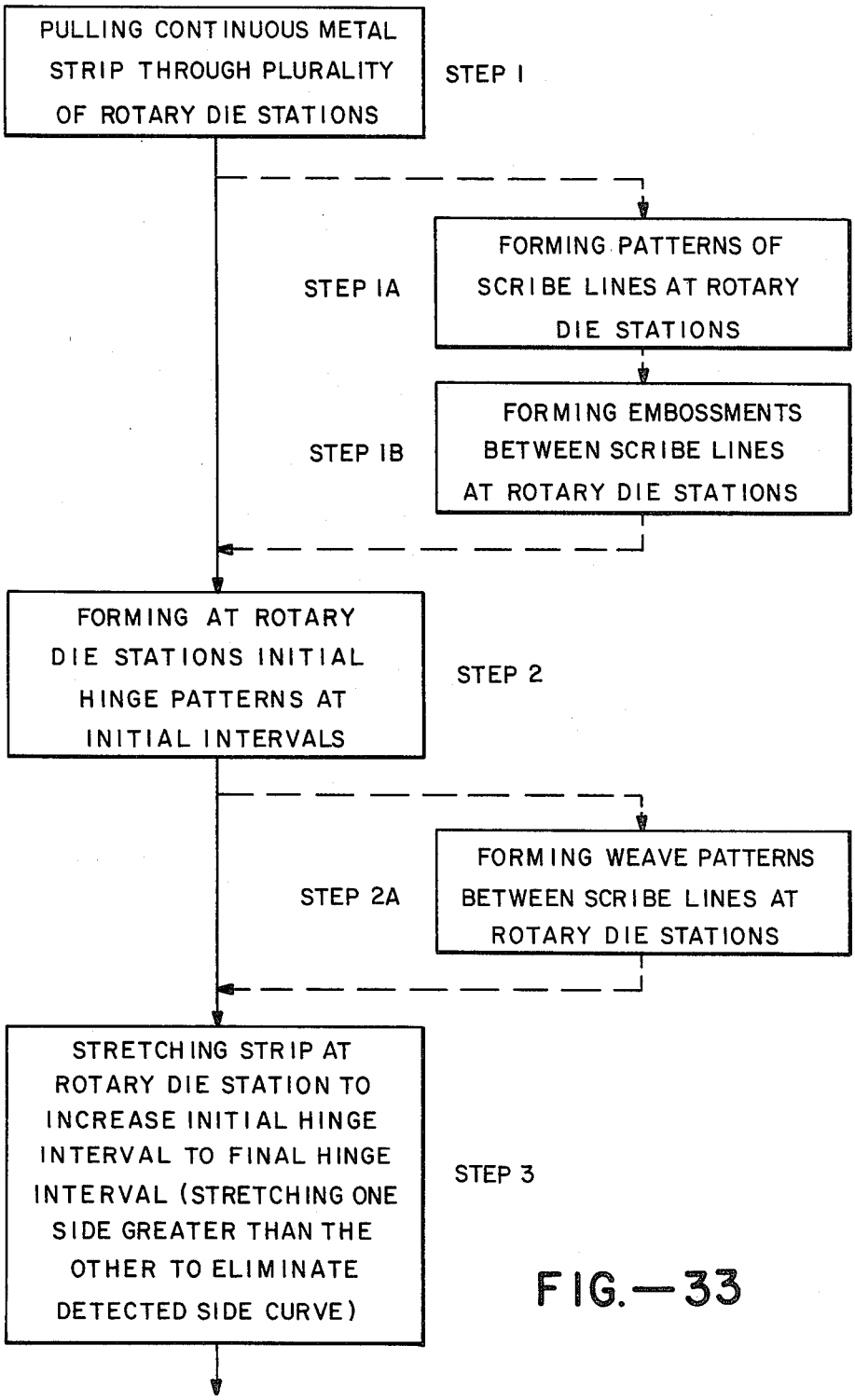
FIG. 33 is a schematic flow diagram of one portion of the method in accordance with this invention.
Figure 34:
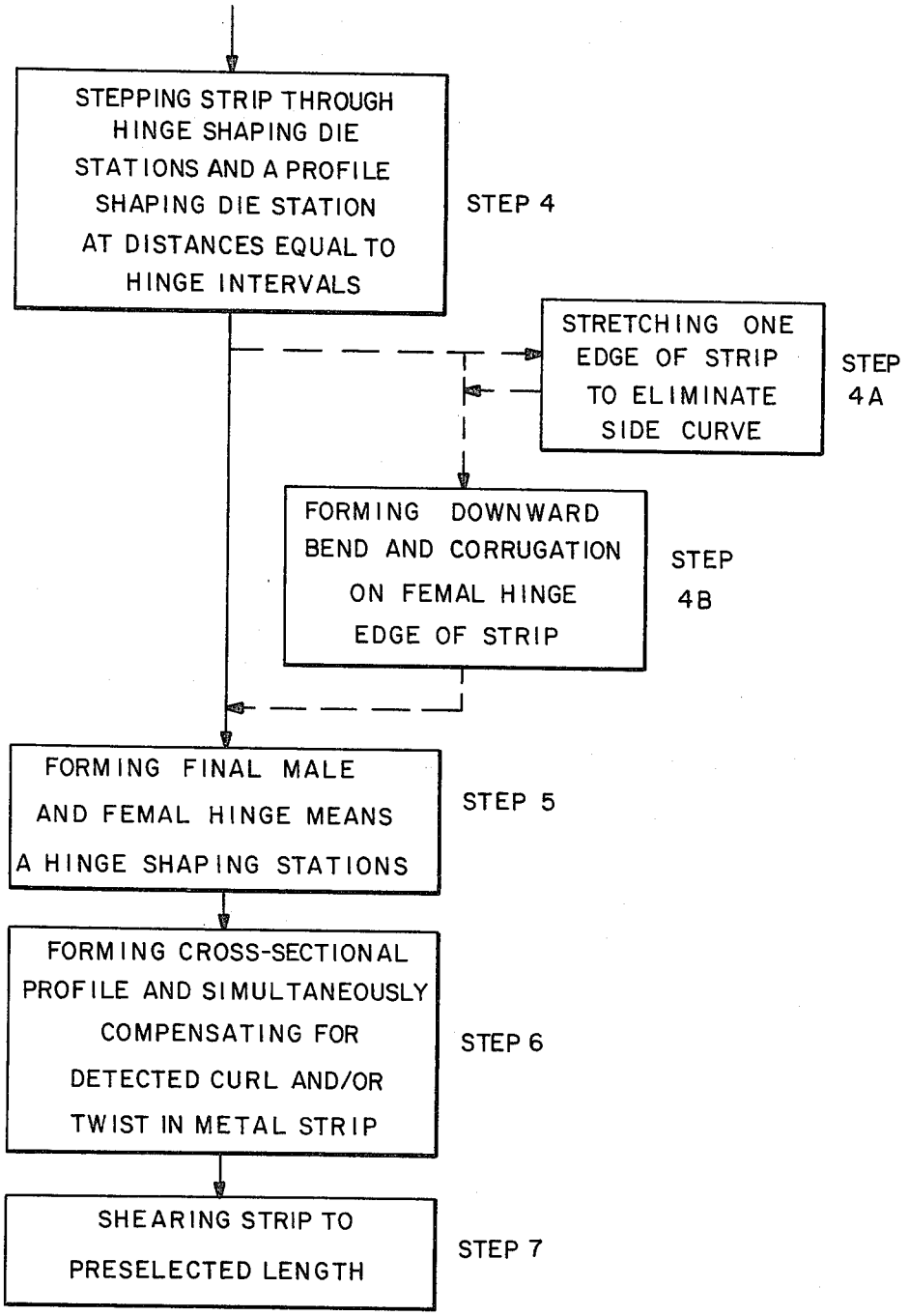
FIG. 34 is a schematic flow diagram of a second portion of a method in accordance with this invention.

FIGS. 33 and 34 depict the various method steps involved in the method aspect of this invention. Referring to FIG. 31, the three essential steps of the method of this invention are depicted. Step 1 involves pulling a continuous metal strip through a plurality of rotary die stations. In the exemplary apparatus shown in FIG. 6, this step is performed by the driving means 230, but it should be apparent that other types of apparatus could be employed to perform this method step. The second essential method step, Step 2 in FIG. 31, involves forming at a rotary die station initial hinge patterns at initial intervals. Step 2 is performed in the exemplary apparatus shown in FIG. 6 at the rotary cutting die stations 170 and 180. It should be apparent that the performance of this method step is not tied to the particular apparatus shown in FIG. 6 but could be performed by rotary die stations of substantially different design. For example, separate rotary die stations could be provided for cutting the individual initial male and female hinge patterns and the die wheels at each station may have any desired number of equally spaced cutting dies mounted thereon at appropriate intervals. The invention is not limited to utilizing rotary dies which cut the precise hinge patterns shown in FIG. 7, but could be utilized to form any type of integral hinge means on a metal drape panel.

The third essential step, Step 3 in FIG. 31, involves stretching the strip at a rotary die station to increase the initial hinge interval to the final hinge interval. Alternatively, at this same rotary die station, this method step can also include stretching one side of the strip a greater amount than the other to eliminate a detected side curve. The exemplary apparatus in FIG. 6 performs this step at equalizing die station 210, but other forms of equalizing die apparatus could be used to perform this step.

FIG. 31 also discloses the preferred optional steps labeled Step 1A, 1B and 2A. Step 1A involves forming a pattern of scribe lines at a rotary die station. This is the step performed by the rotary scribing die station 150 depicted in FIG. 6. Step 1B involves forming embossments between the scribe lines at a rotary die station. This is the method step performed by the rotary embossing die station 160 in FIG. 6. Different types of rotary dies could be utilized for forming the scribe lines and the light embossments and, thus, this method step is not limited to particular types of rotary dies.

Step 2A involves forming a weave pattern between the scribe lines at a rotary die station. This method step is performed in the exemplary apparatus of FIG. 6 at weaving die station 200. It will be apparent that various types of weave patterns and weave dies could be utilized to form a weave pattern on the strip in performing this method step.

Referring now to FIG. 32, the method steps generally performed in the second machine stage 300 depicted in FIGS. 17 and 18 are set forth. Accordingly, Step 4 involves stepping the strip through a plurality of hinge shaping die stations and a profile shaping die station at incremental distances equal to the male and female hinge intervals. This method step is performed in the exemplary apparatus depicted in FIGS. 17 and 18 by the reciprocating drive means 400. It should be apparent, however, that various types of drive means could be employed to perform this method step and, thus, it is not limited to the apparatus depicted in FIGS. 17 and 18.

Step 5 involves forming final male and female hinge means at hinge shaping die stations. This step is performed in a sequential fashion by the exemplary apparatus shown in FIGS. 17 and 18 at the punch die stations 340, 350, 360, and 370. Since various types of hinge forming die stations could be utilized, this method step is not limited to the exemplary apparatus disclosed.

Step 6 involves forming the cross-sectional profile of the strip and simultaneously compensating for detected curl and/or twist in the metal strip. In the exemplary apparatus of FIGS. 17 and 18, this method step is performed by the shaping-compensating die station 380. Since various types of shaping-compensating dies could be utilized to perform this method step, it is not limited to the exemplary apparatus previously described.

Step 7 involves shearing the strip to a preselected length. This particular step can be carried out by any shearing means at a shearing die station 410 in FIGS. 17 and 18.

FIG. 34 depicts two alternative optional steps, including a Step 4A, of stretching one edge of the strip to eliminate a detected side curve. This method step is performed only if Step 3 has not been performed properly to eliminate side curves. Step 4B involves forming a downward bend and corrugation on the female hinge edge of the strip. This optional step is performed by the die station 330 depicted in FIGS. 17 and 18 but could be performed by different types of die apparatus.

The above description constitutes a full disclosure of preferred embodiments of the apparatus and method in accordance with this invention together with some alternative forms which the apparatus might take. It should be understood, however, that numerous modifications in addition to those discussed above could be made without departing from the scope of this invention as claimed in the following claims.

What is claimed is:

1. In a machine for producing metal drape panels having integral male and female hinge means formed thereon at preselected intervals and a preselected cross-sectional profile, in combination:

rotary cutting die means for forming, at precisely spaced intervals, initial hinge patterns for successive pairs of male and female hinge means on a continuous strip of thin metal passing therethrough;

equalizing die means positioned at a die station following said rotary cutting die means for controllably stretching said strip as it passes therethrough to adjust the overall incremental distance between pairs of initial hinge patterns formed thereon; and driving means for pulling said continuous strip through said rotary cutting die means and said equalizing die means while maintaining substantial tension in said strip as it passes through said die means.

2. Apparatus as claimed in claim 1, wherein said equalizing die means includes an adjustable die element having two degrees of adjustment for simultaneously controlling the overall incremental distance between successive pairs of initial hinge patterns and, when required to remove a detected side curve in said continuous strip, to increase the length of one side of said strip with respect to the other.

3. Apparatus as claimed in claim 1, further comprising a second rotary die means for producing a continuous pattern of scribe lines on said strip of metal passing therethrough, said pattern being preselected in accordance with said cross-sectional profile of said metal drape panel.

4. Apparatus as claimed in claim 3, further comprising third rotary die means for forming a pattern of embossments on said continuous strip between said scribe lines.

5. Apparatus as claimed in claim 4, further comprising fourth rotary die means for producing a preselected weave pattern between said scribe lines.

6. In a machine for producing metal drape panels having integral male and female hinge means formed thereon at regular incremental intervals and a preselected cross-sectional profile consisting of a corrugation pattern, in combination:

a plurality of rotary die means; and driving means for pulling a continuous strip of thin metal through successive ones of said rotary die means and maintaining substantial tension in said strip as it passes through said die means;

said plurality of rotary die means including first rotary die means for producing a continuous pattern of scribe lines at positions prearranged in accordance with said cross-sectional profile;

second rotary die means for producing a pattern of embossments on said strip between said scribe lines;

third rotary die means for cutting, at precisely spaced intervals, initial hinge patterns for successive pairs of male and female hinge elements on said strip;

fourth rotary die means for producing a preselected weave pattern between said scribe lines; and equalizes die means positioned at a die station following said third rotary die means and including an adjustable die element having two degrees of adjustment for controllably stretching said strip to adjust the overall increment distance between pairs of hinge patterns thereon and, when required to remove a detected side curve in said strip, for controllably stretching one side of said strip a greater amount than the other.

7. In a machine for producing metal drape panels having integral male and female hinge means formed thereon at regular incremental intervals and a preselected cross-sectional profile, in combination:

rotary scribing die means for forming a pattern of scribe lines on a continuous strip of thin metal;

rotary embossing die means for forming a pattern of embossments between said scribe lines on said strip;

rotary cutting die means for cutting, at precisely spaced intervals on said strip, initial hinge patterns for successive pairs of male and female hinge elements, said precisely spaced intervals being less than said regular incremental intervals by a preselected amount;

rotary weave die means for producing a preselected weave pattern between said scribe lines on said strip;

equalizer die means positioned at a die station following said rotary cutting die means for simultaneously producing a controllable overall stretching of said strip to increase said intervals between said initial hinge patterns to be equal to said regular incremental intervals and a controllable differential stretching of one edge of said strip with respect to the other substantially to eliminate any detected side curve in said strip; and driving means for pulling said continuous strip through all of said die means while maintaining substantial tension in said strip.

8. Apparatus as claimed in claims 1, 6, or 7, wherein said equalizing die means comprises at least two pairs of rotary dies each having a plurality of raised circumferential rings thereon adapted to contact said strip at the edges and at least one central region thereof; means for mounting a first of said pairs of rotary dies in a stationary vertical position to receive said strip therebetween; and means for mounting a second of said pairs of rotary dies adjacent said first pair, including means for separately adjusting the vertical positions of each end of said second pair of dies for separate control of the stretching force on each edge of said strip passing therethrough.

9. Apparatus as claimed in claims 1, 6, or 7, wherein said equalizing die means comprises three pairs of rotary dies, each having a plurality of raised circumferential rings thereon adapted to contact said strip at the edges and at least one central region thereof; means for mounting first and second ones of said pairs of rotary dies in a stationary vertical position to receive said strip therebetween; and means for mounting a third one of said pairs of rotary dies intermediate said first and second pairs, including means for separately adjusting the vertical positions of each end of said third pair of dies for separately controlling the stretching force on each edge of said strip passing therethrough.

10. Apparatus as claimed in claims 1, 6 or 7, further comprising:

punch die means for forming said integral male and female hinge means as successive ones of said intial hinge patterns in said continuous strip are positioned thereunder;

shaping-compensating die means for simultaneously forming said preselected cross-sectional profile and compensating for any inherent twist or curl in said continuous strip passing therethrough;

reciprocating drive means, including means engaging at least a pair of male and female hinge means, for stepping said continuous strip a precise incremental distance equal to said preselected intervals between hinge means during successive actuations thereof, both to position successive portions of said strip accurately under said punch die means and to drive said strip through said shaping-compensating die means; and timing-driving means for producing proper sequential operation of said punch die means and said recirpocating drive means.

11. Apparatus as claimed in claim 10, wherein said shaping-compensating die means comprises adjacent shaping die sections each having respective cross-sectional profiles adapted to form one section of said preselected cross-sectional profile of said strip; means mounting each of said shaping die sections for individual rotation about a common transverse axis; first positioning means for varying the rotational position of one of said shaping die sections with respect to the other; and second positioning means for jointly varying the rotational position of both of said shaping die sections.

12. Apparatus as claimed in claim 10, further comprising a second equalizing die means preceding said punch die means and selectably operable to stretch one side of said strip to remove any detected side curve not eliminated by said first equalizing die means; and rotary die means preceding said punch die means for simultaneously bending and corrugating a predetermined narrow segment of the edge of said strip adjacent said initial female hinge patterns thereon.

13. Apparatus as claimed in claims 6 or 7, wherein said corrugation pattern comprises a generally M-shaped corrugation with a downwardly bent and transversely corrugated female hinge edge and said scribe lines correspond to bending lines for said M-shaped corrugation and said bent female hinge edge, and said apparatus further comprises:

rotary die means for simultaneously bending and corrugating said female hinge edge of said strip;

punch die means for forming said integral male and female hinge means as successive ones of said initial hinge patterns in said continuous strip are positioned thereunder;

shaping-compensating die means for simultaneously forming said preselected M-shaped corrugation and compensating for any inherent twist or curl in said continuous strip passing therethrough;

reciprocating dive means, including means engaging at least a pair of male and female hinge means for stepping said continuous strip a precise incremental distance equal to said preselected intervals between hinge means during successive actuations thereof, both to position successive portions of said strip accurately under said punch die means and to drive said strip through said rotary die means and said shaping-compensating die means; and timing-driving means for producing proper sequential operation of said punch die means and said reciprocating drive means.

14. Apparatus as claimed in claim 13, wherein said shaping-compensating die means comprises adjacent shaping die sections each having respective cross-sectional profiles adapted to form one section of said preselected M-shaped corrugated profile of said strip; means mounting each of said die sections for individual rotation about a common transverse axis; first positioning means for varying the rotational position of one of said shaping die sections with respect to the other; and second positioning means for jointly varying the rotational position of both of said shaping die sections.

15. Apparatus for producing metal drape panels having integral male and female hinge means formed thereon at preselected intervals, a preselected profile in the form of a generally M-shaped corrugation with a downwardly bent and transversely corrugated female hinge edge, and a weave pattern on each of the four segments of said M-shaped corrugation, said apparatus comprising, in combination:

a first machine stage for producing on a continuous strip of thin metal a pattern of scribe lines corresponding to bending lines for said M-shaped corrugation and said bent female hinge edge, initial hinge patterns for said male and female hinge means, and said weave pattern between said scribe lines; and a second machine stage for forming said bent and corrugated female hinge edge, for forming said initial hinge patterns into said male and female hinge means, and for forming said M-shaped corrugated profile;

said first machine stage comprising a plurality of rotary die means and resilient rotary driving means for pulling a continuous strip of thin metal through successive ones of said plurality of rotary die means, a first one of said rotary die means for producing said pattern of scribe lines, a second one of said rotary die means producing a pattern of embossments between said scribe lines to assist in forming said weave pattern; a third one of said rotary die means for cutting said initial hinge patterns at spaced initial intervals less than said preselected intervals by a set amount, a fourth one of said rotary die means for forming said weave pattern, and a fifth one of said rotary die means comprising an equalizing die means positioned at a die station following said third rotary die means for simultaneously producing a controllable overall stretching of said strip to increase said initial intervals to be substantially equal to said preselected intervals and a controllable differential stretching of one edge of said strip with respect to the other substantially to eliminate any detected side curve in said strip;

said second machine stage comprising rotary die means for forming said bent and corrugated female hinge edge on said strip; punch die means for forming sid integral male and female hinge means as successive ones of said initial hinge patterns are positioned thereunder; shaping-compensating die means for simultaneously forming said preselected M-shaped cross-sectional profile and compensating for any inherent twist or curl in said continuous strip passing therethrough; reciprocating drive means, including means engaging at least a pair of male and female hinge means, for stepping said continuous strip a precise incremental distance equal to said preselected intervals between hinge means during successive actuations thereof, both to position successive initial hinge patterns in said strip accurately under said punch die means and to drive said strip through said rotary die means and said shaping-compensating die means; and timing-driving means for producing proper sequential operation of said punch die means and said reciprocating drive means.

16. Apparatus as claimed in claim 15, wherein said equalizing die means in said first machine stage comprises three pairs of rotary dies, each having a plurality of raised circumferential rings thereon adapted to contact said strip at the edges and at least one central scribe line position; means for mounting first and second ones of said pairs of rotary dies in a stationary vertical position to receive said strip therebetween; and means for mounting a third and said pairs of rotary dies intermediate said first and second pairs, including means for separately adjusting the vertical positions of each end of said third pair of rotary dies for separately controlling the stretching force on each edge of said strip passing therebetween; and said shaping-compensating die means comprises adjacent shaping die sections each having respective cross-sectional profiles adapted to form one section of said M-shaped corrugated profile of said strip; means mounting each of said die sections for individual rotation about a common transverse axis; first positioning means for varying the rotational position of one of said shaping die sections with respect to the other; and second positioning means for jointly varying the rotational position of both of said shaping die sections.

17. In a method for forming metal drape panels having integral male and female hinge means formed thereon at preselected intervals and a preselected cross-sectional profile, the steps of:

(1) pulling successive portions of a continuous strip of metal from a supply roll through a plurality of rotary die stations while maintaining substantial tension on said strip;

(2) forming at one of said rotary die stations initial hinge patterns for successive pairs of said male and female hinge means at initial intervals slightly less than said preselected intervals; and (3) stretching said strip at a subsequent one of said rotary die stations by a controlled amount to increase said initial intervals between said successive pairs of initial hinge patterns to be equal to said preselected intervals.

18. The method as claimed in claim 17, wherein said step of stretching includes stretching one side of said strip a greater amount than the other when necessary to eliminate a detected side curve in said strip.

19. The method as claimed in claim 17, further comprising the step of forming at one of said rotary die stations a pattern of scribe lines for assisting in forming said preselected cross-sectional profile.

20. The method of claim 19, further comprising the steps of forming at one of said rotary die stations a pattern of embossments between said scribe lines.

21. The method as claimed in claim 20, further comprising the step of forming at one of said rotary die stations a preselected weave pattern between said scribe lines.

22. In a method for forming metal drape panels having integral male and female hinge means formed thereon at preselected intervals and a preselected cross-sectional profile consisting of a corrugation pattern, the steps of:

(1) pulling successive portions of a continuous strip of metal from a supply roll through a plurality of rotary die stations while maintaining tension on said strip;

(2) forming at one of said rotary die stations a pattern of scribe lines for assisting in producing said corrugated cross-sectional profile;

(3) forming at a second one of said rotary die stations, a pattern of embossments on said strip between said scribe lines;

(4) forming at a third one of said rotary die stations an initial hinge pattern for successive pairs of said male and female hinge elements at initial intervals slightly less than said preselected intervals;

(5) forming at a fourth one of said rotary die stations a preselected weave pattern between said scribe lines; and (6) stretching said strip at a last one of said rotary die stations by a controlled amount to increase said initial intervals between said successive pairs of initial hinge patterns to be equal to said preselected intervals.

23. The method as claimed in claim 22, wherein said step of stretching includes stretching one said of said strip a greater amount than the other when necessary to eliminate a detected side curve in said strip.

24. The method as claimed in claims 17 or 22, further comprising the steps of:

stepping the continuous strip through a plurality of punch die hinge forming stations and a profile shaping die station at precise incremental distances equal to the preselected interval between hinge means;

forming at said punch die stations said integral male and female hinge means as successive ones of said initial hinge patterns in the continuous strip are positioned thereat; and forming the strip at said profile shaping die station into said preselected cross-sectional profile while simultaneously compensating out of the strip any inherent twist or curl detected therein.

25. The method as claimed in claim 24, wherein the step of stepping the continuous strip includes stepping the strip through an edge bending die station; and the method further includes the step of forming at said edge bending die station a bent and corrugated edge on the strip adjacent the initial female hinge pattern.

26. In a method for producing metal drape panels having integral male and female hinge means formed thereon at preselected intervals, a preselected profile in the form of a generally M-shaped corrugation with a downwardly bent and transversely corrugated female hinge edge, and a weave pattern on each of the four segments of said M-shaped corrugation, the steps of:

(1) pulling successive portions of a continuous strip of metal from a supply roll through a plurality of rotary die stations while maintaining tension on said strip;

(2) forming at one of said rotary die stations a pattern of scribe lines for assisting and producing said M-shaped corrugation profile;

(3) forming at a second one of said rotary die stations a pattern of embossments on said strip between said scribe lines to assist in later forming said weave pattern;

(4) forming at a third one of said rotary die stations an initial hinge pattern for successive pairs of male and female hinge elements at initial intervals slightly less than said preselected intervals;

(5) forming at a fourth one of said rotary die stations a preselected weave pattern between said scribe lines;

(6) stretching said strip at a last one of said rotary die stations by a controlled amount to increase said initial intervals between said successive pairs of initial hinge patterns to be equal to said preselected intervals and simultaneously stretching one side of said strip a greater amount than the other when necessary to eliminate a detected side curve in said strip;

(7) stepping the continuous strip through a plurality of punch die hinge forming stations, a rotary edge bending die station, a profile shaping die station; and a shearing die station;

(8) forming at said rotary edge bending die station said downwardly bent and transversely corrugated female hinge edge;

(9) forming at said punch die stations said integral male and female hinge means as successive ones of the initial hinge patterns in the continuous strip are positioned thereat;

(10) forming the strip at said profile shaping die station into said M-shaped corrugation and simultaneously compensating out of the strip any inherent twist or curl detected therein; and

(11) shearing said strip at said shearing die station to complete said metal drape panels.

27. In a machine for producing a decorative weave pattern on a thin, narrow strip of relatively hard metal:

rotary corrugating die means for producing a plurality of separated rows of transverse, parallel corrugations along a continuous thin, narrow strip of said metal passing therethrough; and rotary weave die means receiving said continuous strip of metal for forming a wave pattern thereon comprising rows of adjacent raised and lowered regions in substantial registration with said rows of transverse corrugations previously formed on said strip.

28. Apparatus as claimed in claim 27, wherein said rotary corrugating die means comprises a plurality of sets of gears and mounting means for mounting said sets of gears for rotation in a partially meshed relation at separate spaced locations; said mounting means including adjusting means for controlling the degree of meshing of said gears and thereby controlling the depth of said transverse corrugations in said strip passing therethrough.

29. In a method for forming a decorative weave pattern on a thin, narrow strip of relatively hard metal, the steps of:

(1) pulling successive portions of a continuous roll of said metal strip through a plurality of rotary die stations;

(2) forming on said strip at an initial die station a regular pattern of transverse, parallel corrugations in the form of a plurality of separated rows of said corrugations extending longitudinally on said strip to prestretch the metal material of said strip along said rows; and (3) forming on said strip at a subsequent die station a weave pattern in the form of rows of adjacent raised and lowered regions in substantial registration with said rows of transverse corrugations previously formed thereon.

* * * * *